US006113042A

United States Patent [19]

Welsch et al.

[11] Patent Number: 6,113,042

[45] Date of Patent: Sep. 5, 2000

[54] SELF-ADJUSTING SUPPORT SYSTEM

[75] Inventors: John H. Welsch, Moscow; Bradley J. Carlson, Wilkes-Barre; David A. Reppert, Brodheadsville; Robert W. Altonji, Quakertown; Robert J. Welch; Robert K. Swartz, both of Dallas; Willard J. Sickles, Dalton; Paul J. Fallon, Wilkes-Barre, all of Pa.

[73] Assignee: Metro Industries, Inc., Reno, Nev.

[21] Appl. No.: 08/893,979

[22] Filed: Jul. 16, 1997

[51] Int. Cl.[7] ..... A47B 96/06

[52] U.S. Cl. ..... 248/218.4; 248/235; 108/110; 108/192; 211/187

[58] Field of Search ..... 108/192, 193, 108/110, 147.13, 147.14, 147.15, 147.17; 248/235, 243, 245, 244, 246, 250, 218.4; 211/187

[56] References Cited

U.S. PATENT DOCUMENTS

| | | | |
|---|---|---|---|
| Re. 28,293 | 1/1975 | Butos | 108/144 |
| 4,318,352 | 3/1982 | Friedman et al. | 108/111 |
| 4,627,543 | 12/1986 | Nicely | 211/187 |
| 4,750,626 | 6/1988 | Nicely | 211/187 |
| 4,754,712 | 7/1988 | Olson et al. | 108/111 |
| 4,799,818 | 1/1989 | Sudimak et al. | 403/107 |
| 4,811,670 | 3/1989 | Kolvites et al. | 108/107 |
| 5,127,342 | 7/1992 | Taylor | 108/144 |
| 5,271,337 | 12/1993 | Kolvites et al. | 108/107 |
| 5,676,263 | 10/1997 | Chang | 211/187 |

FOREIGN PATENT DOCUMENTS

WO97/00033 1/1997 WIPO .

*Primary Examiner*—Leslie A. Braun
*Assistant Examiner*—Kimberly Wood
*Attorney, Agent, or Firm*—Fitzpatrick, Cella, Harper & Scinto

[57] ABSTRACT

A system for supporting a member on a support post includes a wedge assembly, having a tapered face and mountable on the support post, and a collar secured to the member to be supported. The wedge assembly has a camming surface, and the collar has a camming portion for abutting the camming surface. In addition, a locking mechanism is mounted to the collar and press-fits against the wedge assembly.

40 Claims, 27 Drawing Sheets

SELF-ADJUSTING SUPPORT SYSTEM

BACKGROUND OF THE INVENTION

1. Field of the Invention

The present invention relates generally to an item-supporting structure that can be used to support shelving or other elements for carrying or supporting any desired item. More particularly, the present invention relates to a support assembly for use in, for example, a knock-down shelving system, to adjustably support shelves.

The support assembly of the present invention can be ideally incorporated into a knock-down shelving system that includes a plurality of support posts for supporting one or more shelves at corner support assemblies thereof. The shelving system will include a snap-on wedge member with detent means for adjustably locating the wedge member at predetermined heights on the support post. In accordance with the present invention, each corner support assembly features a collar, which is structurally associated with the shelf, and a locking mechanism, or flipper, rotatably supported by the collar and actuable between a locking position and an unlocking position. In the unlocking position, the corner support assemblies allow the shelf to translate relative to the support posts. When the flippers are locked, the collars are secured to each respective wedge member and post by a wedging action. Operation of the flipper thus permits easy height adjustment of the shelf without the need for tools, and also without compromising the load bearing capacity of the shelving system.

2. Description of the Prior Art

Shelving systems having adjustable height shelves and so-called "knock-down" type shelving systems are known, and each has utility in many applications. For example, a knockdown shelving system with adjustable height shelves may be used in food service, industrial, commercial, hospital, and similar fields for storage of any desired items.

One type of known adjustable, knockdown shelving system is disclosed in U.S. Pat. No. 3,424,111 (Maslow) and U.S. Pat. No. 3,523,508 (Maslow), which are assigned to the assignee of the subject invention. The adjustable shelving system disclosed in these patents has achieved great commercial success under assignee's trademark SUPER ERECTA SHELF. This shelving system uses a plurality of cylindrical support posts provided with a series of equally spaced, annular grooves on its outer surface. A basic shelving system might include four support posts to support one or more formed-wire shelves, with each shelf having a frusto-conically-shaped collar at each corner for receiving a support post. A two-piece interlocking sleeve fits around the support post. The sleeve features a rib on its interior surface for engaging one of the grooves on the support post and has a frusto-conically-shaped outer surface, which is widest at the bottom, designed to complement the shape of the shelf collars. The support posts fitted with sleeves are received in the collars of each shelf to assemble the shelving system. When assembled, the weight of the shelf creates a radially-inwardly directed force between the collars and sleeves. This force brings the sleeves into a locking relation with the posts and creates a wedging force between the collars and sleeves.

While the SUPER ERECTA SHELF shelving system has proven very successful in providing an easy to assemble shelving system with a substantial load-bearing capacity, adjusting the shelves can sometimes require the use of a hammer or other tool to disengage the shelf collars from the sleeves. The weight of the shelf and any items supported thereon, especially over time, can build up the wedging force between the shelf collars and the sleeves to the point where a significant amount of force is needed to raise the shelf off of the sleeves.

A shelving system with easy to adjust shelves is provided in U.S. Pat. No. 5,415,302. This shelving system uses hanger brackets to permit easy installation and adjustment of the shelves without requiring the disassembly of the entire shelving system or the use of tools. This shelving system, known under the trademark QWIKSLOT SHELF, is also assigned to the assignee of the subject invention. The QWIKSLOT SHELF shelving system uses support posts formed with a plurality of elongated slots at regular vertical intervals for receiving the hanger brackets. The slotted support post can also have annular grooves as discussed above in the SUPER ERECTA SHELF shelving system. A notch in each hanger bracket receives a truncated corner of a shelf.

The hanger brackets used in the QWIKSLOT SHELF shelving system allow for easy adjustment of the shelves. A potential drawback in some applications, however, is that shelves secured by means of the hanger brackets do not provide the heavy-duty load bearing capacity of other shelving systems, such as the SUPER ERECTA SHELF shelving system.

Still another type of successful shelving system, sold and marketed under the trademark METROMAX and also assigned to the assignee of the subject invention, features a "knock-down" shelving system that uses triangular support posts. Such a system is the subject of U.S. Pat. No. 4,811,670, No. 4,964,350, No. 5,271,337, and No. 5,279,231.

In U.S. Pat. No. 4,811,670, a corner assembly for securing each corner of a shelf to the triangular support post includes a wedge member, a corner bracket structurally associated with the shelf and a collar. The wedge member snap-fits on the support post, and the collar and corner bracket form a sleeve around the support post. The formed sleeve fits against the support post and wedge member and supports the shelf by a wedging force.

The shelving systems in U.S. Pat. No. 4,964,350, No. 5,271,337, and No. 5,279,231, feature modular shelves in combination with the triangular support posts. The modular shelves include a rectangular shelf frame formed from two end beams connected to two side beams. A center beam may be inserted between the end beams, parallel to the side beams, to increase the load-bearing capacity of the system. A plurality of plastic shelf mats are adapted to be snap-fit onto the shelf frame. The shelf frame is secured to the support post by corner assemblies comprised of a corner portion of the end beam, a wedge member and a separate collar. A sleeve formed by the corner portion and the collar is seated on the support post and wedge member and secured by a wedging action. Two lock cylinders lock the collar to the corner portion to secure the sleeve.

While the design of the modular shelf provides many advantages, adjusting the shelf can, on occasion, require use of a hammer or other tool to disengage the formed sleeve from the wedge member for the same reasons discussed above in connection with the SUPER ERECTA SHELF shelving system.

Despite the significant utility and commercial success of the above-described shelving systems, a need exists for an improved support assembly in which the shelving system may be easily assembled and the shelves easily adjusted to different heights without the need for any tools, and in which the shelves are secured in a static manner to provide a load carrying capacity suitable for heavy-duty use.

SUMMARY OF THE INVENTION

For purposes of explanation, the present invention will be described with reference to a shelving system.

However, in its broadest aspect, this invention relates to a support assembly capable of use in many types of support systems. The support system can support shelves, as described below in greater detail, and other elements for carrying a wide variety of items. For example, the support system can support combinations of shelving, drawers, work surfaces, racks, bins, hooks and the like.

Accordingly, it is a principal object of the present invention to provide a shelf support assembly for use in an easy to assemble and easy to adjust heavy-duty shelving system.

Another object of the present invention is to provide a shelf support assembly that can be quickly and easily adjusted.

It is another object of the present invention to provide a shelf support assembly that is statically secured to the shelving system to provide substantial load-bearing capacity.

Still another object of the invention is to provide a shelf support assembly that is readily adaptable to various types of support posts.

Another object of the invention is to provide a shelf support assembly with a self-aligning feature to make it easier and faster to assemble the shelving system.

In accordance with one aspect of the invention, a system for supporting a member on a support post comprises a wedge assembly having a tapered face and mountable on the support posts, with the wedge assembly having a camming surface, and a collar secured to the member to be supported. The collar has a first surface for abutting the camming surface and a second surface for press-fitting against the wedge assembly.

The second surface can be provided on a locking mechanism rotatably mounted to the collar. A pin on the collar can be provided for rotatably receiving the locking mechanism.

In accordance with another aspect of the invention, a support system comprises a support post, a wedge assembly, having a tapered portion, mounted on the support post, and support means for adjustably supporting a member to the support post. Also provided is aligning means for aligning the wedge member and the support means.

The support means can include a locking mechanism having a first position for press-fitting against the wedge assembly and a second position for releasing the press-fitting.

In accordance with still another aspect of the invention, a system for supporting a member comprises a support post, a wedge assembly with a tapered face and mounted to the support post, with the wedge assembly having a longitudinal axis and a camming surface, and a collar secured to the member to be supported. A first surface on the collar and the camming surface on the wedge assembly are engagable to turn the wedge assembly about its longitudinal axis by a camming action from the collar. The collar also includes a second surface for press-fitting against the wedge assembly.

The second surface can be provided on a locking mechanism mounted to the collar. The locking mechanism can be actuable between a first position compressing the wedge assembly and supporting the member and a second position not compressing the wedge assembly.

In accordance with yet another aspect of the invention, a system for supporting a member on a support post comprises a wedge assembly, having a tapered portion, mounted on the support post, and support means, secured to the member, for adjustably supporting the member to the support post. In addition, aligning means aligns the wedge assembly on the support post.

These and other objects, aspects, features and advantages of the present invention will become apparent from the following detailed description of the preferred embodiments taken in conjunction with the accompanying drawings.

DESCRIPTION OF THE PREFERRED EMBODIMENTS

For purposes of explanation only, and to illustrate in part how the present invention may be adapted easily to conventional shelving technology, the support assembly of the present invention will be described below in use with a knock-down shelving system. The shelving system generally includes a plurality of support posts, e.g., four, arranged to support one or more shelves at corner assemblies thereof. Of course, the support assembly of the present invention can be used in various types of support systems, e.g., cabinets, closets, etc., with a shelving system being only one example thereof. Moreover, the support assembly can be used in conjunction with many shelf embodiments and is not limited to use with a corner of a shelf or, for that matter, a corner of any supported member. In the examples given below, the support assembly is structurally associated with a wire shelf frame designed to be fitted with plastic shelf mats. However, the support assembly of the present invention will be readily adaptable to many other shelf embodiments including, but not limited to, a wire shelf or a solid sheet metal shelf.

Figure 1:
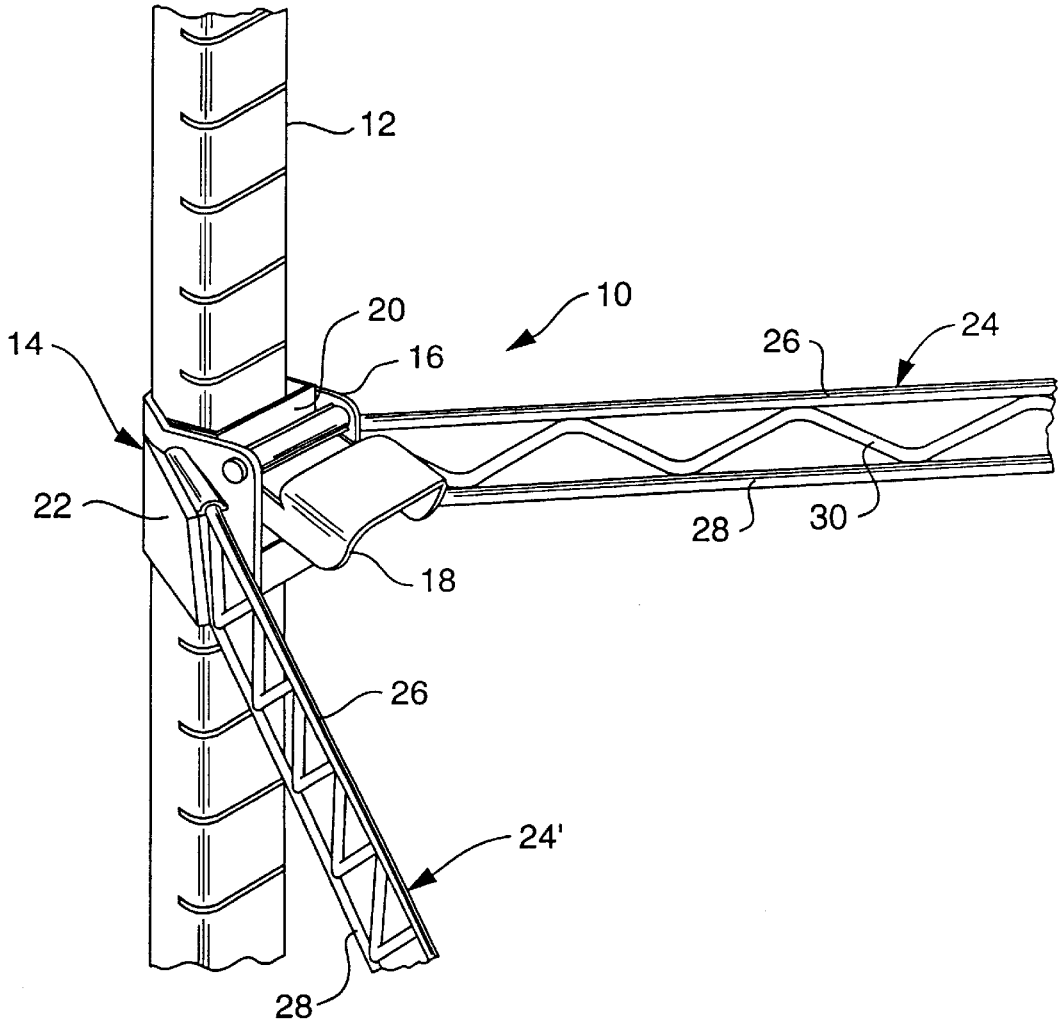
FIG. 1 is a partial perspective view of a shelving system in accordance with a first embodiment of the present invention.

FIG. 1 illustrates one corner of a shelving system utilizing the support assembly in accordance with the present invention. In this figure, a wire shelf frame 10 is positioned on an elongated support post 12 by a corner support assembly 14.

Generally speaking, the corner support assembly 14 is comprised of a collar 16 and a locking mechanism, or flipper, 18 rotatably mounted to the collar. In this view, the flipper is shown in its unlocked position. The corner support assembly is secured between an end outer rail 24 and a side outer rail 24' which form part of the shelf frame 10. A tapered wedge member 20 is positioned on the post where the shelf frame is to be secured. With the flipper in the closed position, the wedge member is compressed against the support post 12, and the corner support assembly 14 surrounds the support post and wedge member like a sleeve and is seated thereon to support the shelf frame with a wedging force.

Although FIG. 1 is a partial view showing only one corner of the shelving system, it will be understood that the shelving system will normally include a plurality of support posts 12 corresponding in number to the number of corner support assemblies 14 in the shelf frame 10. In a typical shelving system, one or more rectangularly-shaped shelf frames will have a corner support assembly in each of four corners.

In this embodiment, the wire shelf frame 10 is part of a modular shelf that is formed by securing the outer rails 24 and 24' to the corner support assemblies 14 by conventional means such as welding. In a rectangular shelf configuration, for example, two end outer rails 24 and two side outer rails 24' will be secured between four corner support assemblies to comprise the wire shelf frame. As illustrated in FIG. 1, each outer rail includes a top rail 26, a bottom rail 28 and a snake-like rail 30 secured between the top and bottom rails for stability. One or more transverse rails (unshown) can be secured between parallel outer rails for additional support and to increase the load-bearing capacity of the shelf.

The preferred material for the collar 16 and the outer rails 24 and 24' is metal, most preferably cold rolled steel or stainless steel. These compositions are relatively light weight, provide high structural rigidity, and are inexpensive to manufacture by known metal forming methods. Further, stainless steel is resistant to corrosion and easily cleaned, so that it may be utilized in many sanitary applications, including food service applications.

Figure 2A:
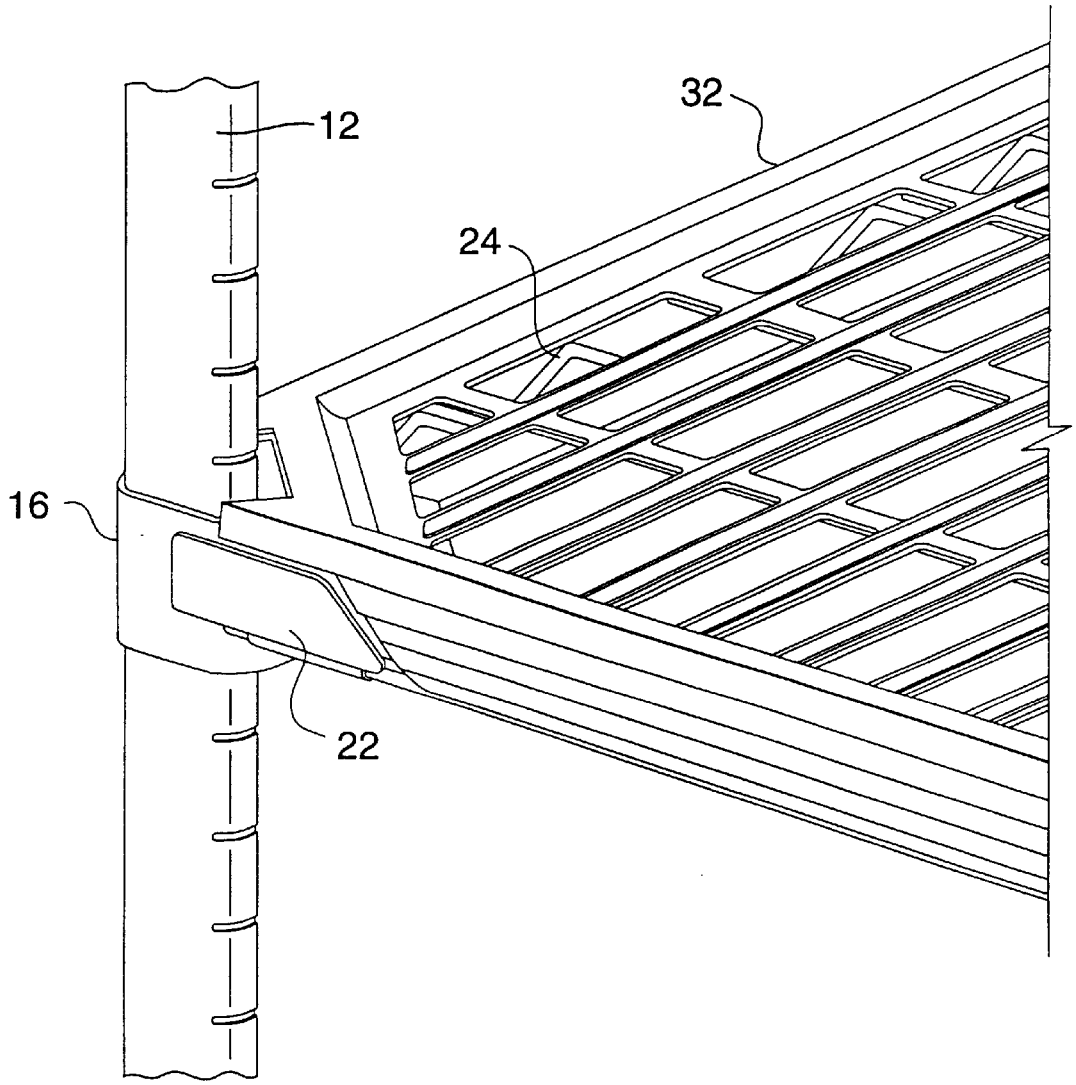
FIG. 2A is a partial perspective view of one corner of the shelving system in accordance with the first embodiment shown in FIG. 1.
Figure 2B:
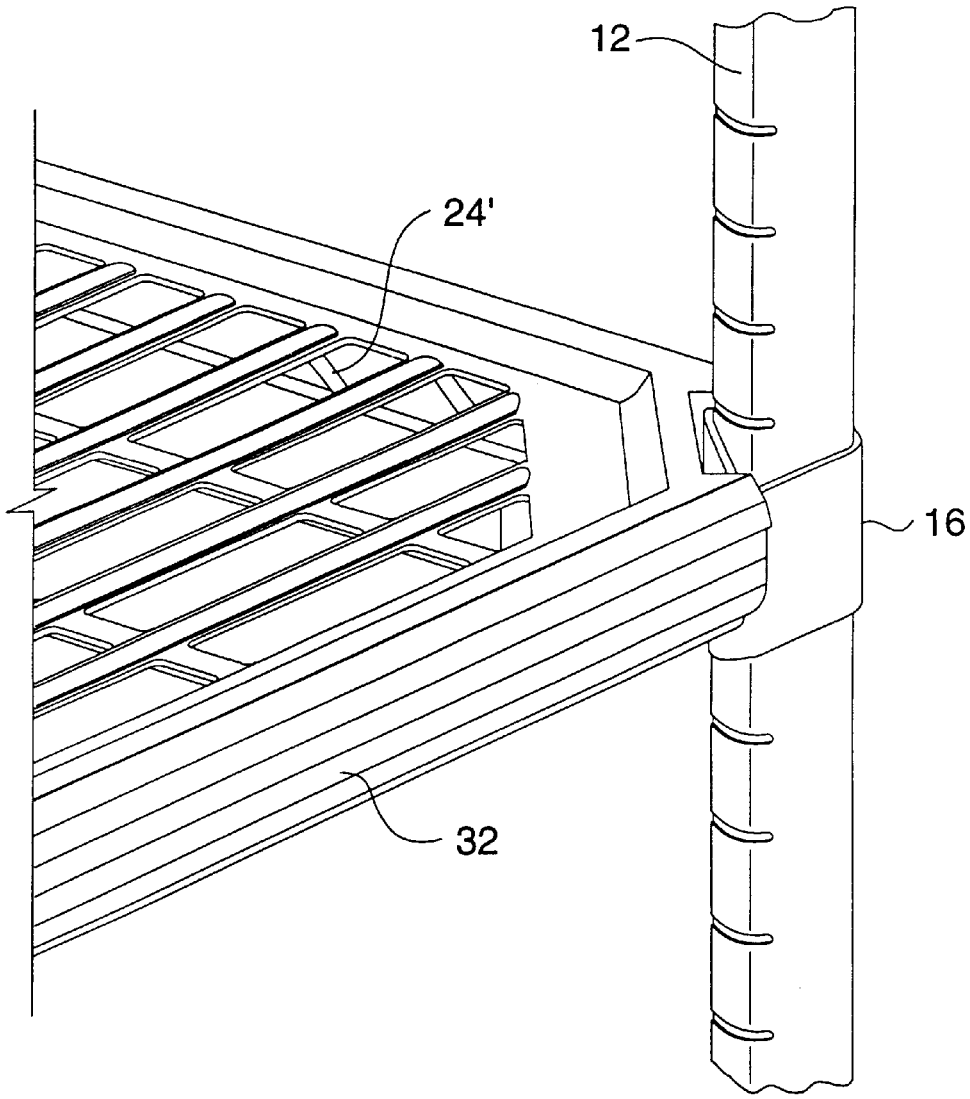
FIG. 2B is a partial perspective view of another corner of the shelving system in accordance with the first embodiment shown in FIG. 1.

With reference to FIG. 2A, the wire shelf frame supports one or more removable shelf mats 32 to complete the modular shelf. The shelf mats are preferably made of a polymer material and can be snap-fit or otherwise friction fit to the wire shelf frame. This allows the shelf mats to be easily removed and cleaned, if desired. FIG. 2A also illustrates shields 22 that can be snap-fit onto the shelf frame at one or both ends of the side outer rail 24' to provide an aesthetically pleasing, finished look. The vertical edges of the shelf mats 32 at the corners are cut away to accommodate the shields 22. The shields are preferably used only on the side outer rails 24', which are normally longer than the end outer rails 24. FIG. 2B is a perspective view of the shelving system looking at one end of the shelf, which is not provided with the shield.

Figure 3:
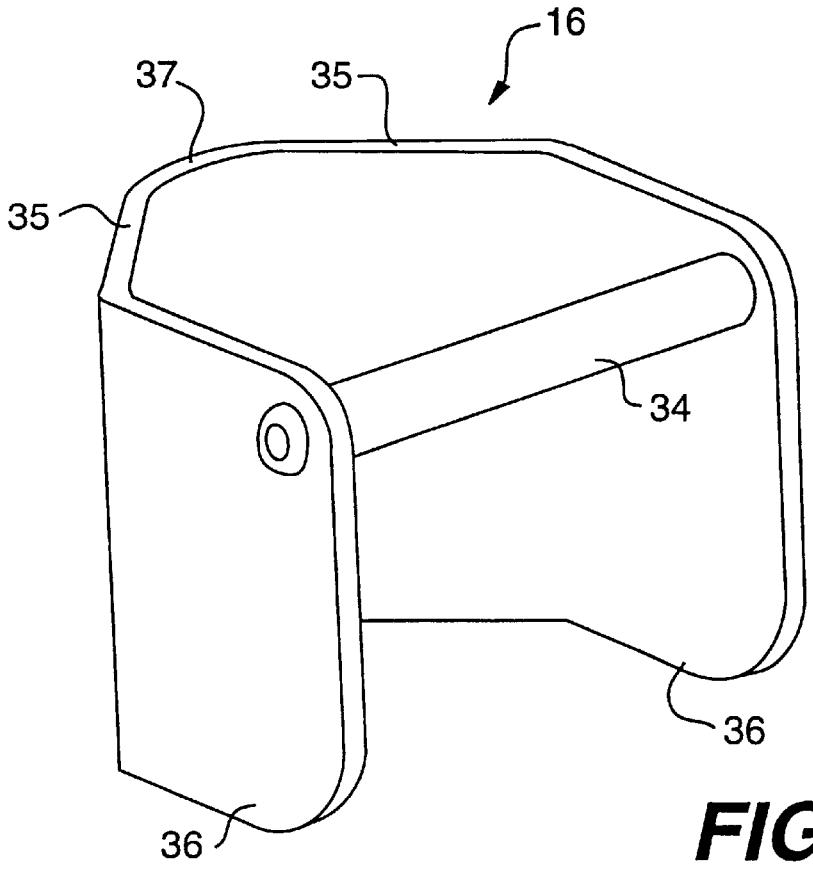
FIG. 3 is a perspective view of a collar in accordance with the first embodiment of the present invention.

An isolated view of the collar 16 is provided in FIG. 3. The collar includes a cylindrical shaft 34, preferably non-rotatable, secured between two lateral sides 36 for rotatably supporting the flipper 18. In accordance with the present invention, a rear section of the collar 16 joining, or connecting, the two lateral sides is contoured to fit the outward-facing shape of the post 12. In this embodiment, the post has a generally triangular cross-section as discussed in detail below. The rear side is thus shaped to have a straight portion 35 angled from each lateral side and joined by a rounded apex 37.

Figure 4:
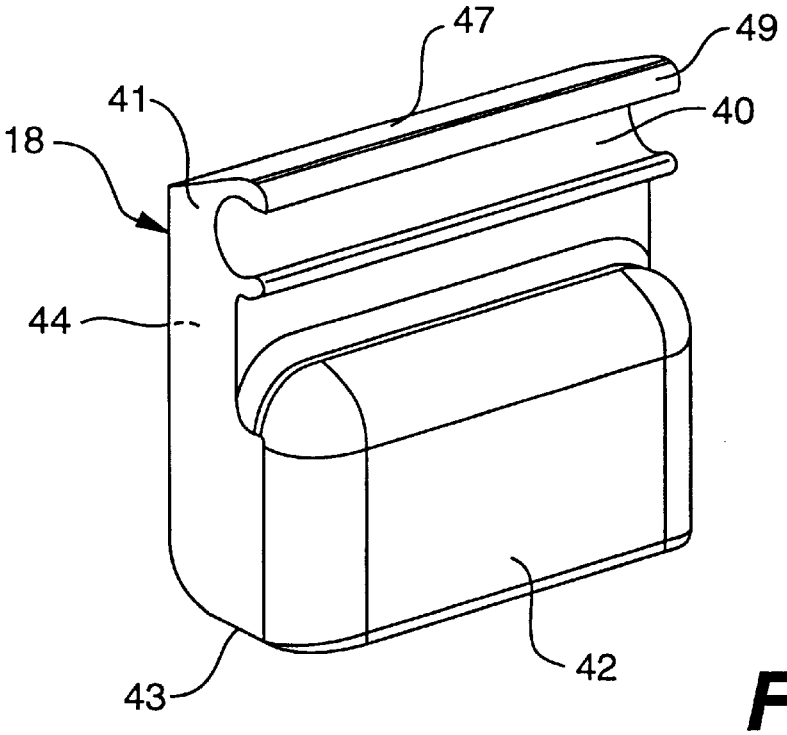
FIG. 4 is a perspective view of a flipper in accordance with the first embodiment of the present invention.

FIG. 4 illustrates the flipper 18 in accordance with a first embodiment of the subject invention. The flipper, which is preferably integrally formed, has an upper end 41 and lower end 43. Further, the top end has a flat portion 47 and a rounded portion 49, with the rounded portion defining part of an open cylindrical cavity 40 for receiving and containing the shaft 34 of the collar 16. The lower end includes a preferably flat manipulating portion 42 for grasping by the user. A rear face 44 of the flipper, which extends at an angle from the flat portion 47 and cannot be seen in FIG. 4, is shaped to complement the shape of the wedge member 20, which in this embodiment is substantially flat. The flipper is mounted on the collar to rotate about a longitudinal axis of the shaft. The preferred material for the flipper is a rigid molded plastic such as, for example, reinforced nylon.

While in this embodiment the cylindrical cavity 40 and shaft 34 interface to rotatably support the flipper on the collar, other means for rotatably supporting the flipper could be provided without departing from the scope of the invention. For example, the flipper could have rounded beads on either end that would sit in complementary-shaped indents on the collar, or conversely, the collar could have the rounded beads which mate with indents on opposite ends of the flipper.

Figure 5:
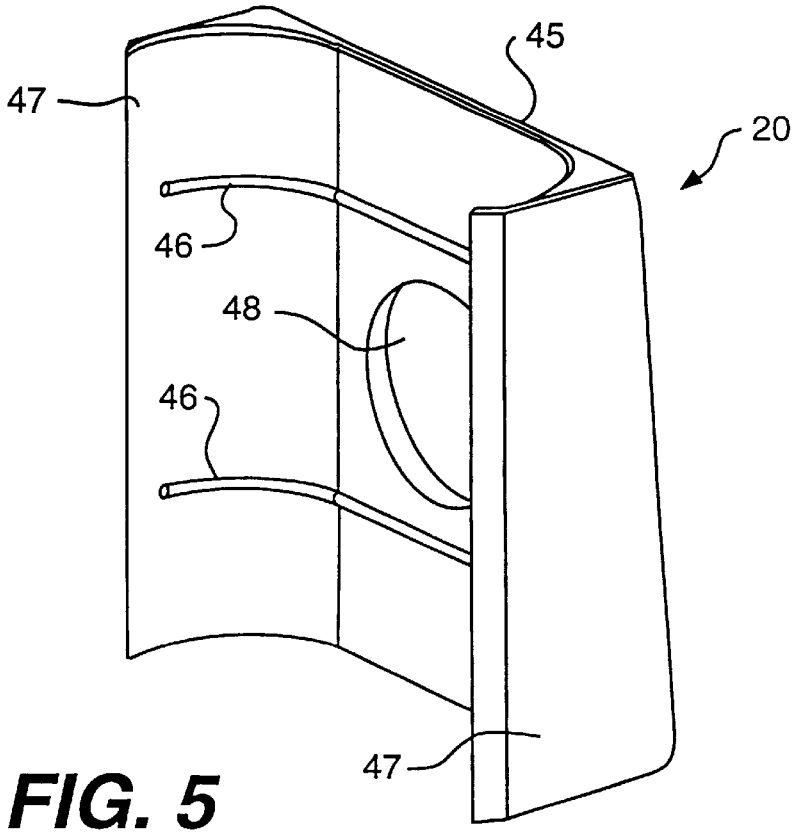
FIG. 5 is a perspective view of a wedge member in accordance with the first embodiment of the present invention.

FIG. 5 shows a wedge member 20 designed to clip onto an interior face of the support post 12. The wedge member includes a front portion 45 flanked by two contoured lips 47 for clipping, or snap-fitting, the wedge member onto the support post. In addition, detent means such as internal beads, or ribs, 46 are provided on the internal surface of the wedge member and are spaced at intervals corresponding to the spacing of grooves on the support post.

The configuration of the internal beads is designed to mate with the configuration of the grooves in the support post. Although two internal beads are shown in the preferred embodiment, the wedge member may comprise one or more internal beads. Further, the number, size and shape of the internal beads may be varied for a number of reasons including, for example, the size of the wedge member 20, the size of the spacing of the grooves in the support posts, and the shelving application. The internal beads provide vertical support when they are seated in the grooves of a support post. To further secure the wedge member on the support posts, additional vertical support is provided by a wedge action as discussed below. It will therefore be appreciated that the wedge member 20 may be clipped on to the support posts at any incremented height, and further may be translated up and down to any other incremented height.

A cut-out 48 can be provided in the front portion 45 to view optional numbers on the support post for vertically aligning the wedge member with wedge members on other support posts.

The outer surface of the front portion is substantially flat in this embodiment to correspond to the substantially flat rear face 44 of the flipper. Although not readily recognizable in FIG. 5, the front portion is also slightly tapered from its upper end to its lower end, such that the lower end is wider and extends toward an interior of the shelving system. In the preferred embodiment, the taper is shallow to maximize rigidity and minimize the thickness of the wedge member. For example, the taper is of the order of 4°. A better view of the tapered shape of the wedge member is provided in FIG. 7A, which will be discussed below.

With the tapered shape of the wedge member, an inwardly directed force is created by the weight of the shelf assembly to provide a wedging action between the corner support assembly and the wedge member. The preferred material for the wedge member is a molded plastic, such as reinforced nylon. Such a molded plastic wedge member can be easily clipped on to and off of the support post. However, other materials which provide the desired characteristics may be used.

Figure 6C:
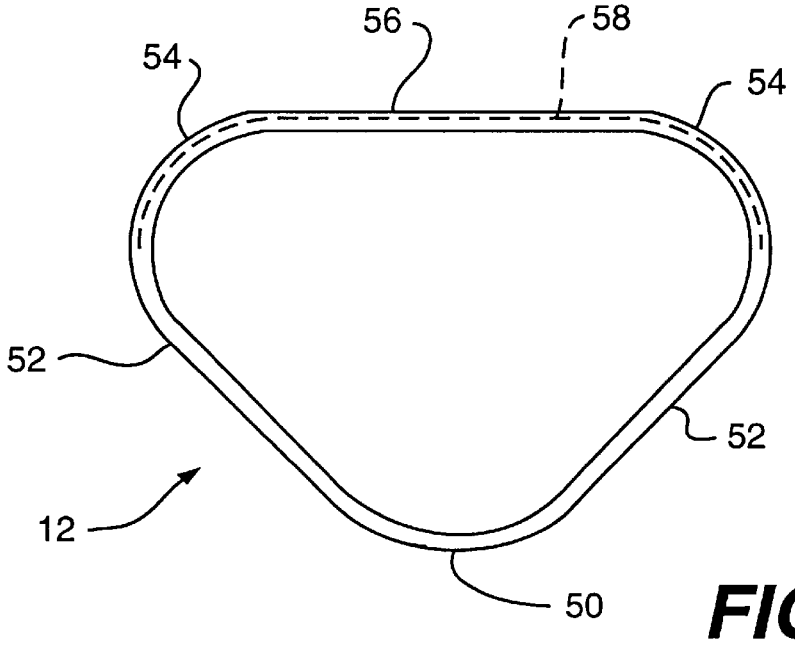
FIG. 6C is a top plan view of the support post shown in FIG. 6A in accordance with the first embodiment of the present invention.
Figure 6A:
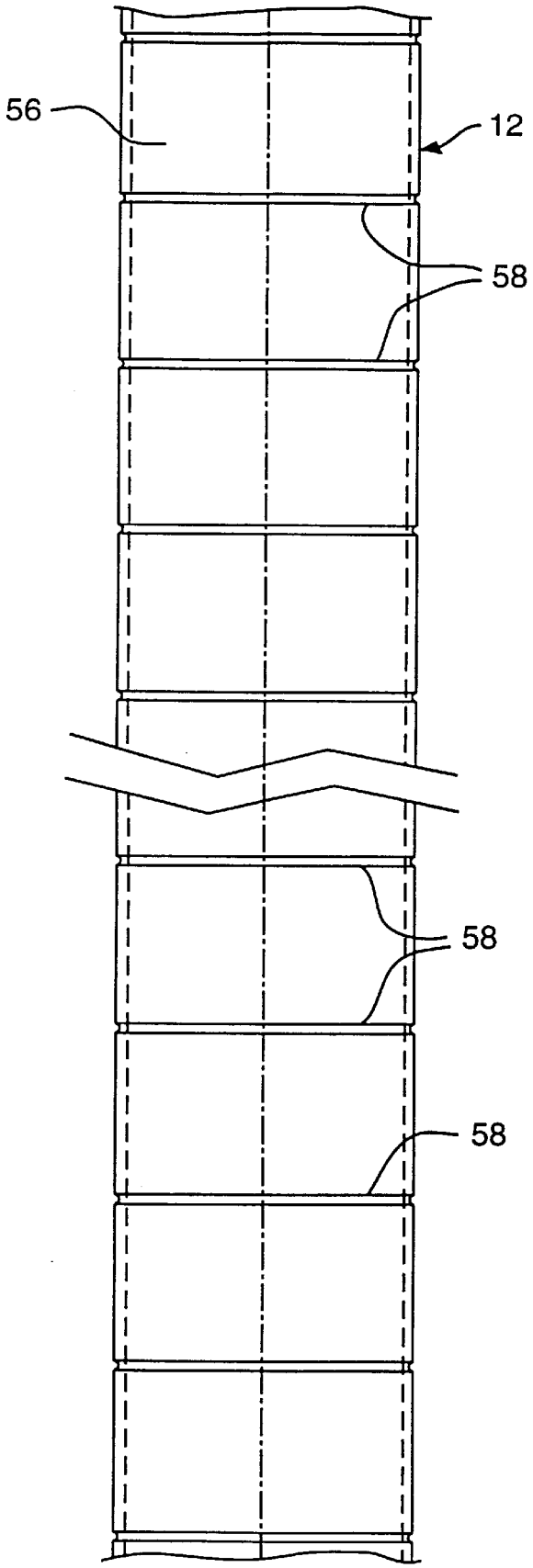
FIG. 6A a partial front elevational view of a support post in accordance with the first embodiment of the present invention.
Figure 6B:
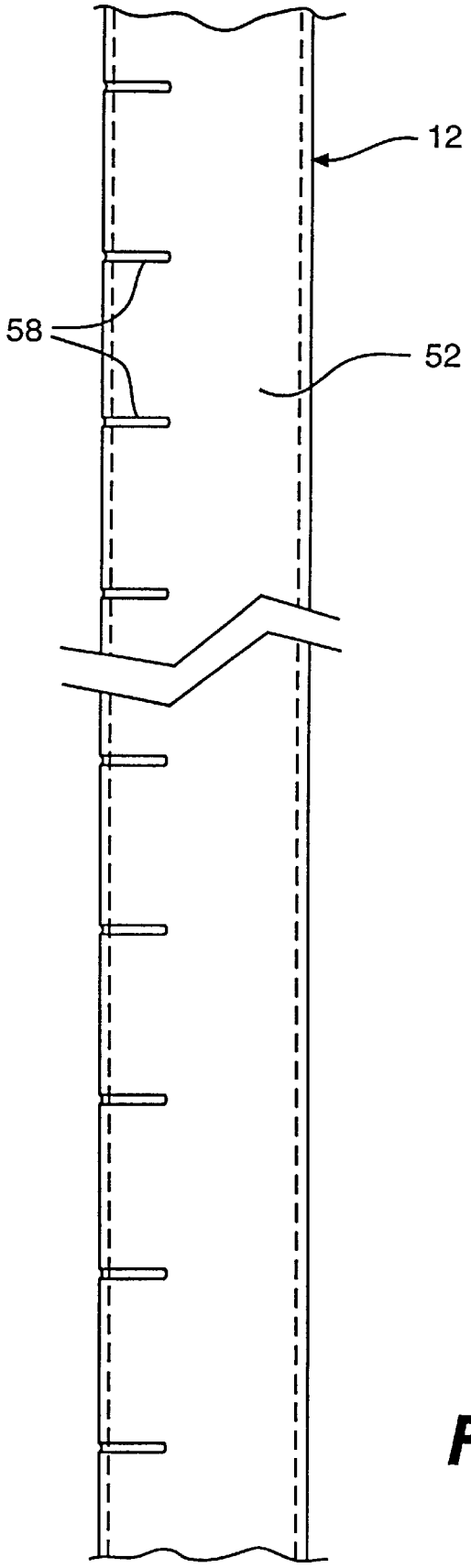
FIG. 6B is a partial side elevational view of the support post shown in FIG. 6A in accordance with the first embodiment of the present invention.

A vertical support post 12 in accordance with this embodiment of the invention is shown in FIGS. 6A, 6B and 6C. As best seen in FIG. 6C, the support post 12 has a generally right equilateral triangular cross-section, which can also be described as a trilobal cross-section. A right-angled apex 50 and two flat exterior sides 52 face the exterior of the shelving system, and interior angled apexes 54 and an interior side 56 of the support post face the interior of the shelving assembly. Accordingly, as explained in detail in U.S. Pat. No. 4,811,670, which is herein incorporated by reference, the triangular geometry of the support post provides multi-directional stability, particularly in the directions of critical stress forces, i.e., in a direction parallel to the edges of the shelf.

The support post includes a plurality of horizontal grooves 58 that are preferably, but not necessarily, evenly spaced in the longitudinal direction of the post. In FIGS. 6A through 6C, the grooves are shown to extend entirely across the interior side 56 of the post and partially across the apexes 54 of the post. of course, grooves of different lengths could be provided on the support post. The grooves receive the internal beads 46 of the sleeve. As will be appreciated, other comparable detent means for positioning the wedge member to the support post, such as detent tabs and detent steps as disclosed in U.S. Pat. No. 4,811,670, could be used without departing from the scope of the present invention.

Although unshown in the drawings, the top end of each support post 12 can be fitted with an end cap and the bottom end with a caster, a vertically-adjustable foot, an end cap, etc. As one example, the bottom end of the support post can be fitted with a stem receptacle for threadably receiving a leveling leg.

Figure 7A:
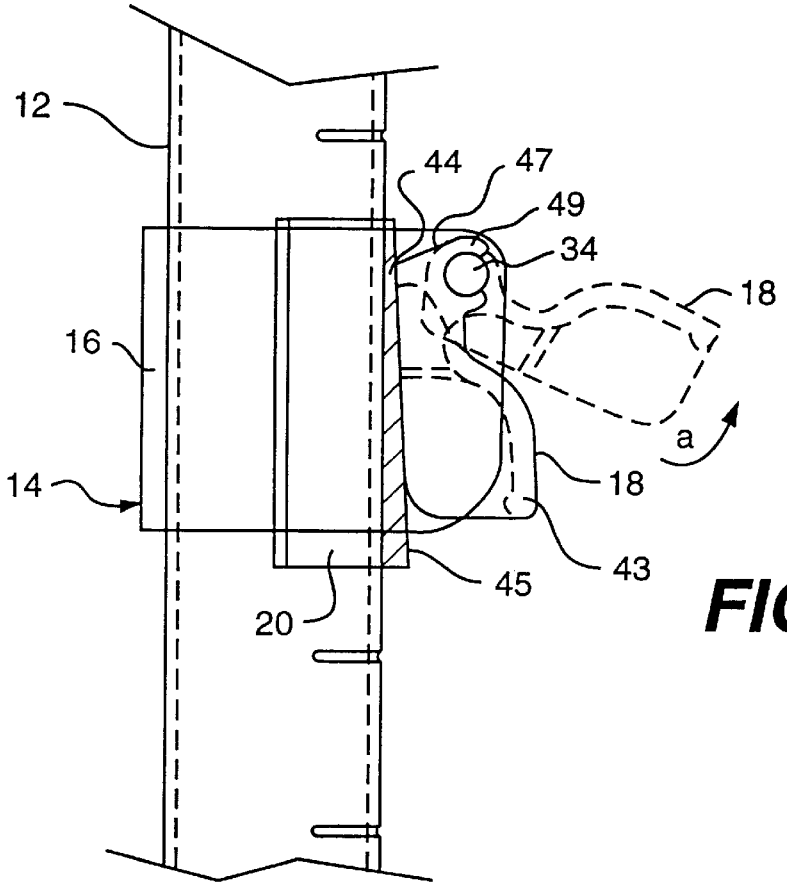
FIG. 7A is a partial side elevational view, partially in cross-section, of the support post and corner assembly in accordance with the first embodiment of the present invention.
Figure 7B:
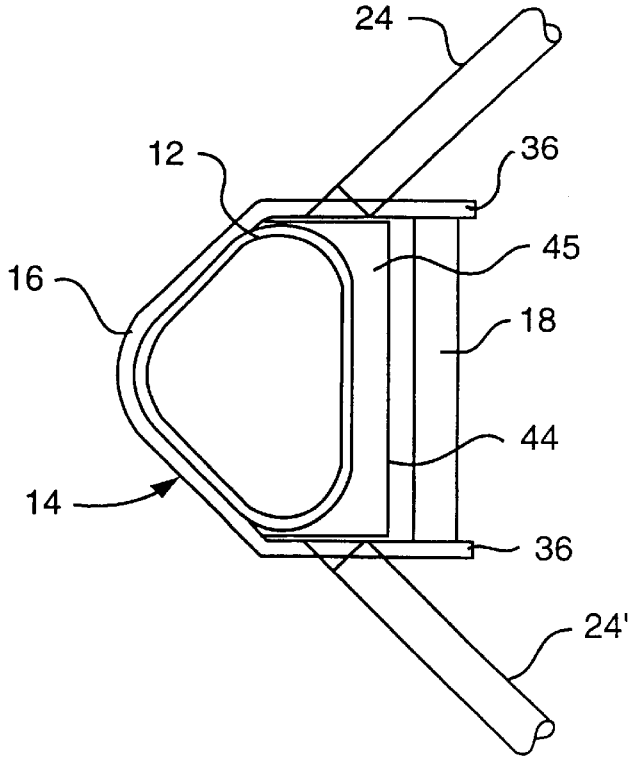
FIG. 7B is a partial stop plan view of the support post and corner assembly in accordance with the first embodiment of the present invention.

FIGS. 7A and 7B illustrate how the collar support assembly 14 is secured to the support post 12. For the sake of simplicity, the outer rails 24 and 24' have been deleted in FIG. 7A but are shown to be secured to the lateral sides 36 of the collar 16 in FIG. 7B. When the wedge member 20 is mounted on the support post 12 at the desired height, the corner support assembly 14 is positioned over the wedge member and the support post. In this regard, the collar 16 and flipper 18 together form a sleeve that fits over the wedge member and the support post. When the flipper 18 is in the closed, or locked, position as shown in solid lines in FIG. 7A, the rear face 44 of the flipper directs an inward radial compression force against the wedge member 20, in which the front portion 45 is crosshatched for clarity. In addition, the tapered shape of the wedge creates a wedge action between the wedge member and the flipper for supporting the shelf assembly. It will be appreciated that the greater the weight on the shelf, the greater the downward force and thus the greater the wedging force.

FIG. 7A will also be referred to in discussing two salient features of the present invention. The first feature relates to the ability of the flipper to easily and quickly release the wedging action between the corner support assembly and the wedge member. This frees the shelf to slide up or down the support posts. To release the wedging action, the closed flipper 18 is rotated in the counter-clockwise direction of arrow a to its unlocked position as represented by the dashed lines. By pivoting the flipper about the shaft 38 in this manner, the compression force between the flipper 18 and the wedge member is released. Actuation of the flipper by the user thus allows for quick and reliable releasing of the wedging action.

Another salient feature of the invention is directed to the ability of the flipper to allow the corner support assembly to slide over the support post and mounted wedge member (or members). At rest, the flipper 18 normally hangs, by gravity, in substantially the same position shown in solid lines in FIG. 7A, i.e., with the lower end 43 directed downwardly. Now, with the flipper in this position and the corner support assembly disposed below a wedge member mounted on the support post, when the shelf is raised toward the wedge member the lower (and wider) end of the wedge member will initially contact the flat portion 47 of the upper end of the flipper, causing it to rotate counterclockwise about the shaft 34 in the direction of arrow a. This action raises the flipper toward its unlocked position, whereby the rounded portion 49 of the upper end is substantially opposite the wedge member. As the flipper is biased toward its unlocked position, the contour of the upper end allows the flipper to pass completely over the wedge member.

The ability of the flipper to be rotated automatically by the wedge member allows the support assembly to be easily raised up the support post. As will be appreciated, when the support assembly is raised over a series of wedge members spaced apart on the support post, the flipper will rotate automatically as described above as it passes over each wedge member and, as it clears the wedge member, rotate in the opposite direction back to its at-rest position. However, this action of the flipper takes place in only one direction, i.e., raising of the support assembly 14 relative to the support post, and in that sense can be described as a ratchet-like movement. When the support assembly slides along the support post in the opposite direction, i.e., downward toward a mounted wedge member, the rear face 44 of the flipper mates with the front portion 45 of the wedge member and creates a wedging action. Of course, if the flipper is held in its raised, or unlocked position, the flipper will clear the wedge member and the support assembly can slide downward over the support post and mounted wedge member(s).

The ability of the corner support assembly to translate relative to wedge member mounted on the support post and slide completely thereover enables both the assembly of a shelving system and an adjustment of the height of the shelves to be accomplished with ease. To adjust the height of an individual shelf, for example, a second set of wedge members can be clipped on to the support posts at the desired new height. The flippers at the corner support assemblies are then rotated to the unlocked position, releasing the compression force applied to the wedge members by the flippers and allowing the shelf to be raised or lowered. To raise the height of the shelf, the shelf is raised along the support posts to allow the flippers to pass over the second set of wedge members in the manner described above. Once the flippers clear the wedge members (such that the flipper can rotate back to its at-rest position), the shelf can be lowered, whereby the flippers will seat on their respective wedge members to create the desired wedging force. The first set of wedge members can then be removed from the support posts if desired.

It will be appreciated that with this arrangement that allows the flippers to freely rotate, the flippers "self-regulate" themselves as they return to the at-rest position to match the slope of the wedge member. The flippers thus automatically come to rest against a respective wedge member regardless of the slope of the wedge member to create the necessary wedging force.

To assemble a shelving system with a plurality of shelves utilizing the corner support assembly of the present invention, the shelves can be stacked on the floor one atop the other. One set of wedge members for each shelf is positioned on the support posts at the desired shelf heights, and then the support posts are inserted in the aligned corner support assemblies of the shelves. Each shelf can then be raised, one-by-one, over the sets of wedge members provided for lower shelves and then over its designated set of wedge members positioned at the desired height. As the shelf passes over the designated wedge members, it is lowered back thereon to allow the flippers, which fall back to the at-rest position once the wedge members are cleared, to engage and seat against the wedge members to create a wedging force for supporting the shelf. This "bottom up" assembly allows the shelving system to be put together quickly and easily.

This static system of supporting the shelves, i.e., securing the shelves directly to the support posts, allows for significant load-bearing capacity while providing an easy to assemble and easy to adjust support system.

Figure 8A:
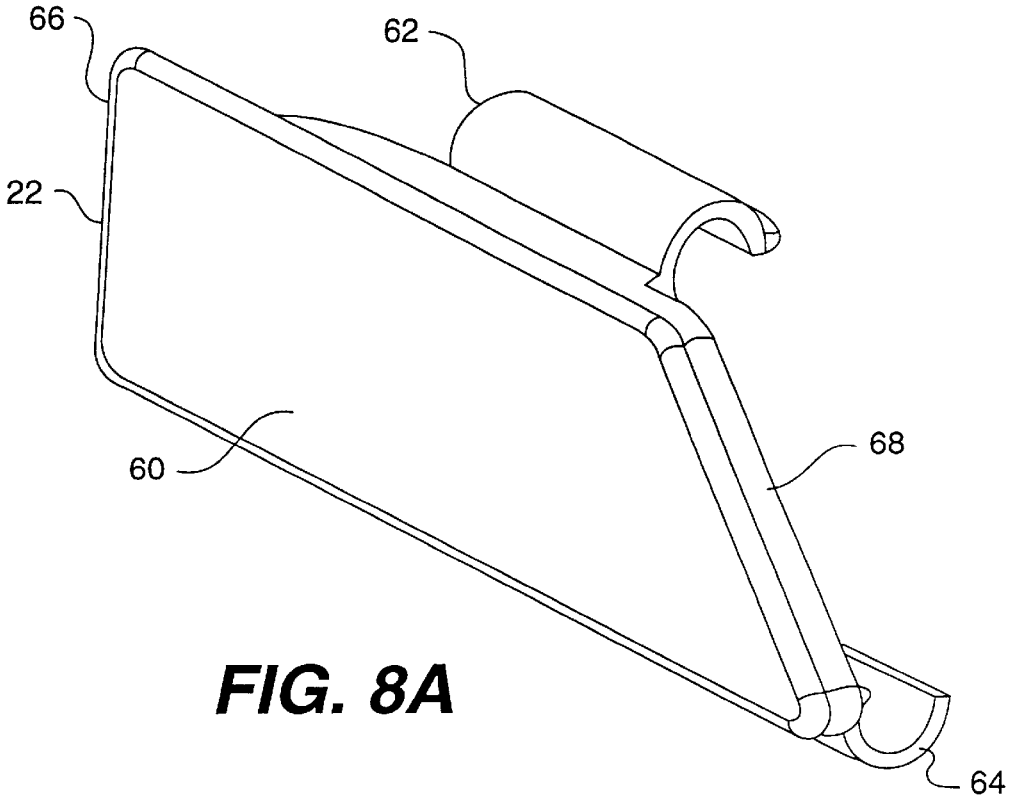
FIGS. 8A and 8B are perspective views of a left-hand shield in accordance with the present invention.
Figure 8B:
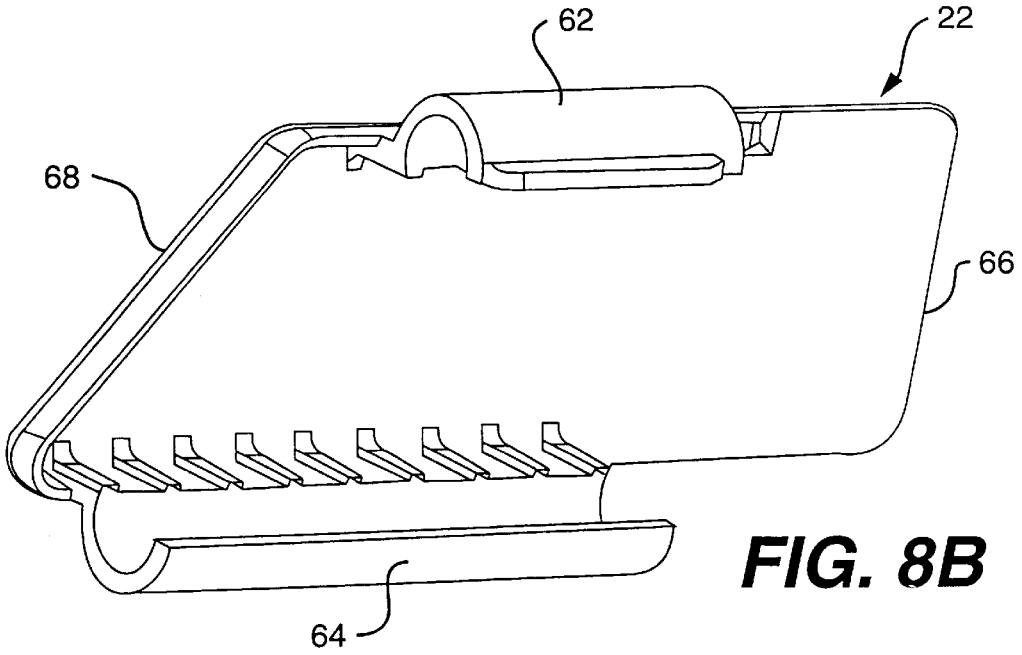

With respect to the shields 22 which may be fitted to the shelf assembly, isolated front and rear views of a left-side shield 22 are provided in FIGS. 8A and 8B, respectively. The shield is preferably formed of a molded plastic having the resiliency necessary to be snap-fit over the outer rails. In FIG. 8A, the shield 22 is shown to have a substantially flat front face 60 and upper and lower rounded forms, 62 and 64, for snap-fitting onto the outer rails 24'. The front face is also defined by one vertical edge 66 and one angled edge 68. As better seen in FIG. 8B, the upper and lower forms have a substantially semi-circular cross-section and sufficient length to define an extended cylindrical cavity. When in position, the upper form 62 snap-fits over the top rail 26 and the lower form 64 snap-fits over the bottom rail 28. Although unshown in the drawing, a right-hand shield is shaped in substantially the same way as the left-hand shield, except that the vertical edge and the angled edge are reversed.

While the support system of the present invention has been described above in use with substantially triangular-shaped support posts, support posts of other shapes can be used without departing from the scope of the invention. It will be appreciated that the underlying principals of the invention can be used to provide a collar that is contoured to fit around a support post of many shapes and fitted with a rotatable flipper also contoured to complement the outer surface of a wedge member secured to the support post. The wedge member, as well, can be readily adapted to fit support posts of various shapes. The second, third and fourth embodiments described below will better illustrate the ability of the support system of the present invention to be used with different types of support posts.

Figure 9:
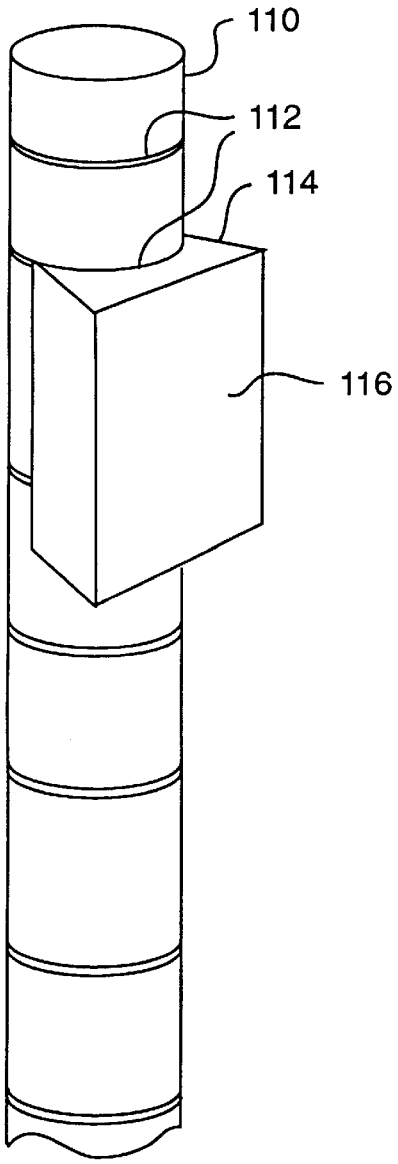
FIG. 9 is a partial perspective view of a support post and wedge member in accordance with a second embodiment the present invention.
Figure 10:
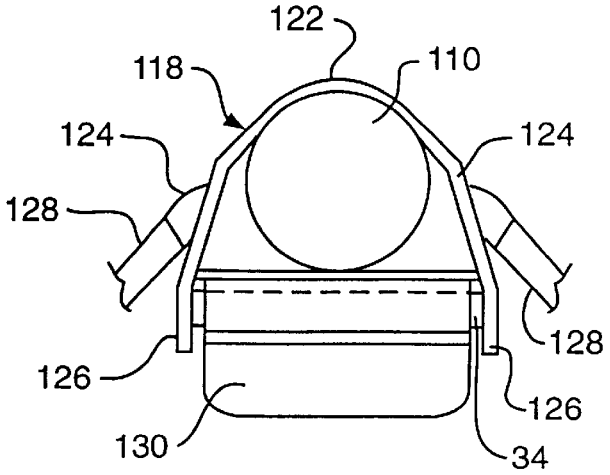
FIG. 10 is a top view of a corner of a shelving system in accordance with the second embodiment of the present invention.
Figure 11:
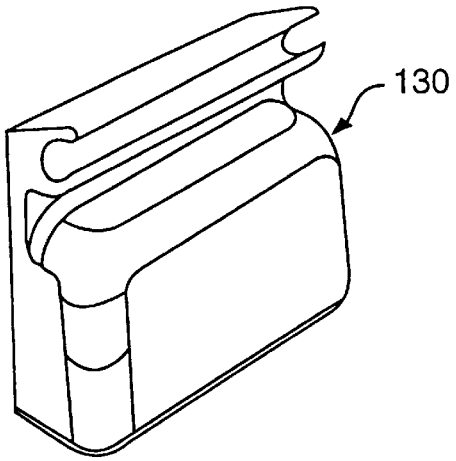
FIG. 11 is a perspective view of a flipper in accordance with the second embodiment of the present invention.

The second embodiment illustrated in FIGS. 9 through 11 shows a support system of the present invention in use with a cylindrical support post. The cylindrical post 110 includes annular grooves 112 for receiving and positioning a wedge member 114 in substantially the same manner described above in the first embodiment, i.e., by using detent means comprised of the annular grooves 112 and complementary beads on the interior surface of the wedge member 114. Of course, the interior surface of the wedge member will be arcuate in shape to complement the surface of the cylindrical support post. The outer surface 116 of the wedge member is substantially flat in FIG. 9. As in the first embodiment, the wedge member is tapered to provide a slightly thicker, lower portion extending toward the interior of the shelving system.

A collar 118 shown in FIG. 10 has a different contour than the collar disclosed in the first embodiment in order to accommodate the shape of the support post. In this second embodiment, an apex 122 of the collar is more rounded to fit the cylindrical support post. Rear sides 124 join the lateral sides 126 of the collar to the apex. With this configuration, outer rails 128 of the wire shelf frame are preferably, but not necessarily, secured to the rear sides 124 of the collar. A flipper 130 of substantially the same shape and characteristics as in the first embodiment is rotatably secured on a shaft 34 extending between the lateral sides 126 of the collar. As in the first embodiment, the rear face of the flipper is substantially flat to complement to outer surface 116 of the wedge member.

Figure 12A:
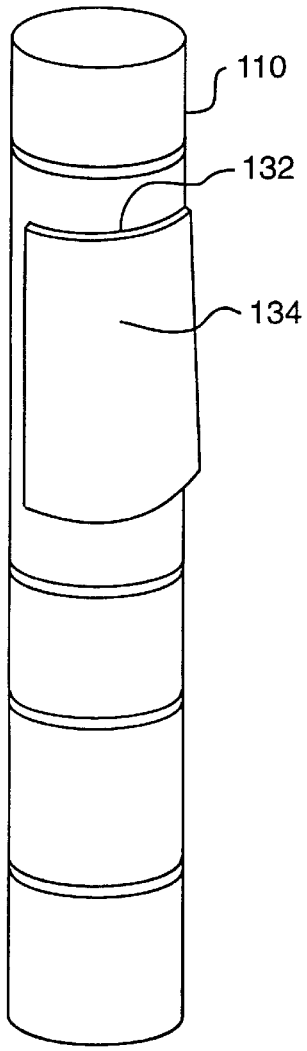
FIG. 12A is a partial perspective view of a support post and wedge member in accordance with a first modification of the second embodiment of the present invention.
Figure 13A:
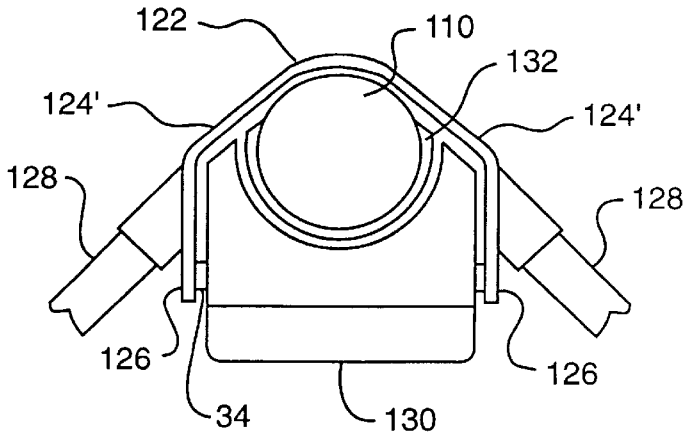
FIG. 13A is a top view of a corner of a shelving system in accordance with the modified embodiment shown in FIG. 12A.
Figure 14A:
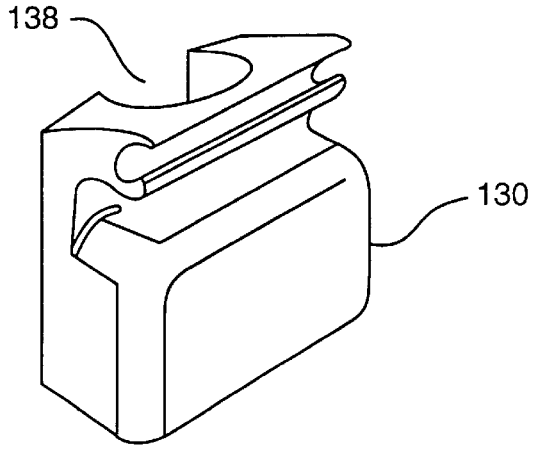
FIG. 14A is a perspective view of a flipper in accordance with the modified embodiment shown in FIG. 12A.
Figure 12B:
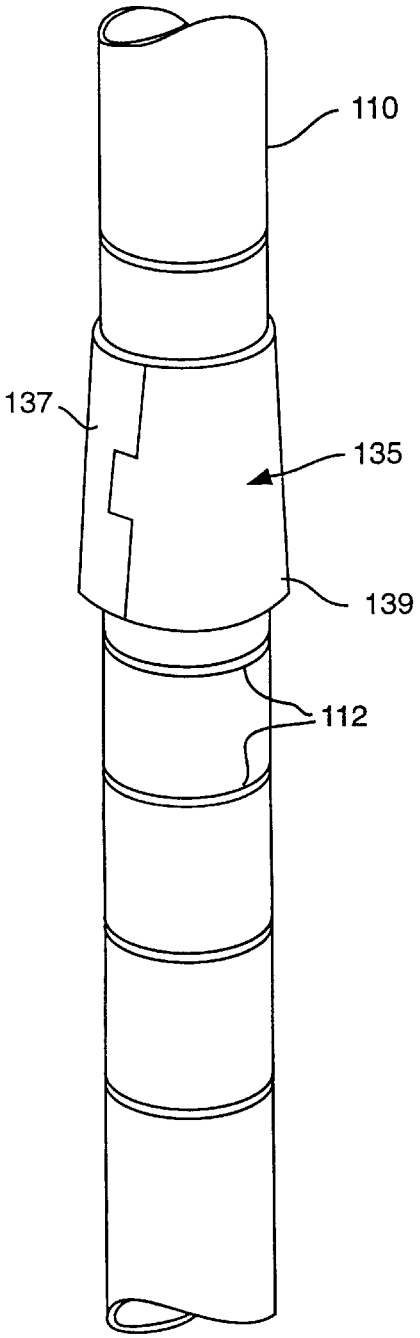
FIG. 12B is a partial perspective view of a support post and wedge member in accordance with a second modification of the second embodiment of the present invention.
Figure 13B:
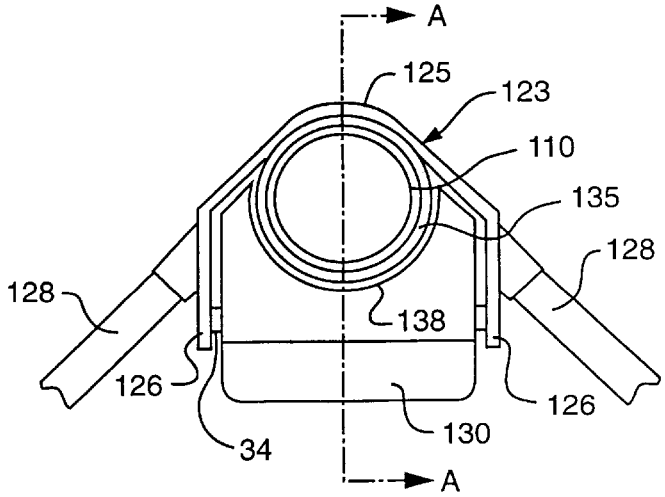
FIG. 13B is a top view of a corner of a shelving system in accordance with the modified embodiment shown in FIG. 12B.
Figure 14B:
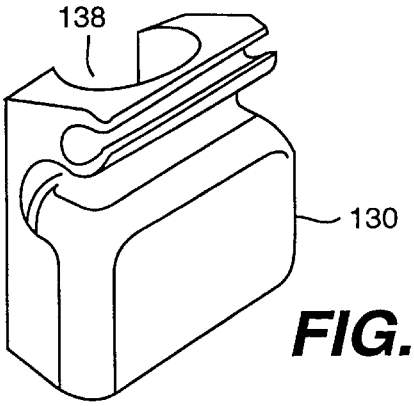
FIG. 14B is a perspective view of a flipper in accordance with the modified embodiment shown in FIG. 12B.

In a first modified version of the second embodiment, shown in FIGS. 12A, 13A and 14A, the outer surface of the wedge member is altered. With reference to FIG. 12A, a wedge member 132 having an arcuate outer surface 134 instead of a flat surface is employed. This modified wedge member fits the support post like a sleeve. The same or comparable detent means as discussed above can be used to secure the wedge member to the support post 110. An optional tab could extend from one or both lateral edges of the wedge member for additional support.

To accommodate for the rounded wedge member, rear sides 124' of the collar 116 are modified as shown in FIG. 13A to fit the contour of the wedge member 132. In this modification, the outer rails 128 are secured to the lateral sides of the collar 126. In addition, the rear face of the flipper 130 is cut out to form a semi-circular cavity 138 for engaging the wedge member. The modified complementary shapes of the wedge member and the flipper create a wedging action sufficient to support a shelf when the flipper closes to compress the wedge member, which is still tapered in the manner described above.

Another modification of the second embodiment is shown in FIGS. 12B, 13B, 14B and 23. This modification features a two-piece interlocking sleeve 135 of type used in the SUPER ERECTA SHELF shelving system described above. In that regard, the sleeve 135 is comprised of first and second halves, 137 and 139, respectively, that are snap-fit around the support post and secured to each other by, for example, a tongue and groove arrangement. The sleeve includes one or more ribs (unshown) on its interior surface for engaging an equal number of grooves on the support post. The sleeve also has a frusto-conically-shaped outer surface, which is widest at the bottom.

Figure 23:
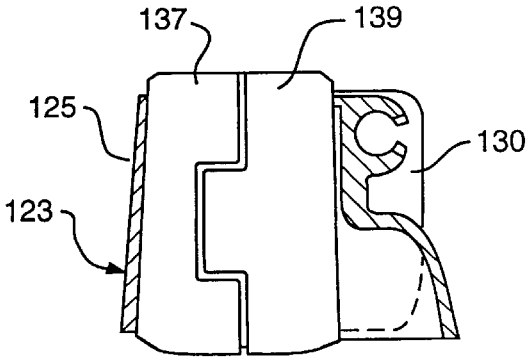
FIG. 23 is a side elevational view of the support assembly in accordance with the modified embodiment shown in FIG. 12B.

To accommodate for the frusto-conical shape of the sleeve, a collar 123 will be provided with a rear section 125 that slopes outwardly from top to bottom to complement the slope of the sleeve. The slight slope of the collar 123 is best seen in FIG. 23. The top view of the support assembly in FIG. 13B also illustrates this aspect of the invention. The flipper 130 is substantially identical to the flipper illustrated in FIG. 14A and discussed above, and likewise creates a wedging force when closed to compress the sleeve.

Figure 15:
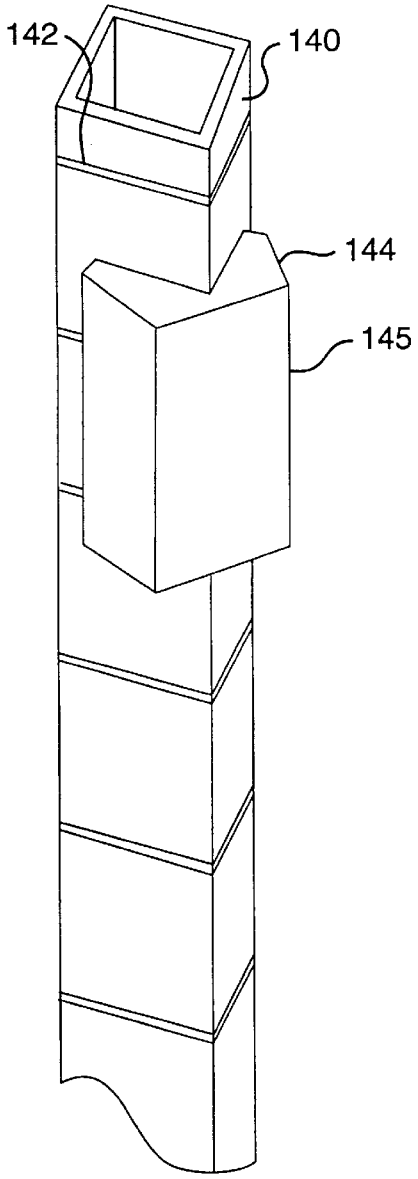
FIG. 15 is a partial perspective view of a support post and a wedge member in accordance with a third embodiment of the present invention.
Figure 16:
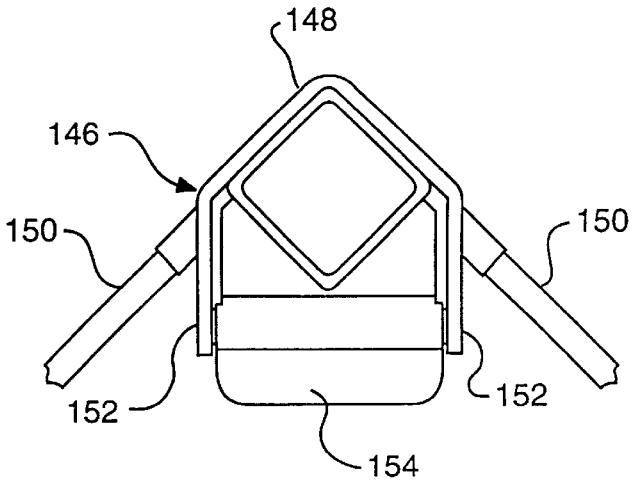
FIG. 16 is a top view of a corner of a shelving system in accordance with the third embodiment of the present invention.
Figure 17:
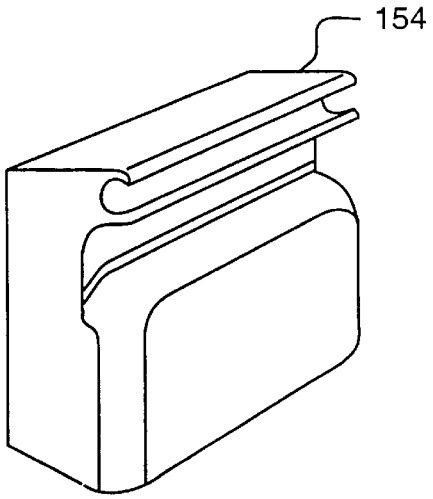
FIG. 17 is a perspective view of a flipper in accordance with the third embodiment of the present invention.

A third embodiment of the present invention is shown in FIGS. 15 through 17. This embodiment features use of a square support post 140 with outer peripheral grooves 142 equally-spaced in the longitudinal direction. In keeping with the shape of the support post, an inner surface of wedge member 144 has a right-angled V-shaped cut-out for receiving a corner of the support post. Other aspects of the wedge member are the same as in embodiments 1 and 2 described above, i.e., the wedge member includes detent means for mating with the support post and has a tapered outer surface 145.

FIG. 16 shows a collar 146 with a right-angled rear side 148 to complement the outer corner of the support post. Outer rails 150 of the shelf frame are preferably secured to lateral sides 152 of the collar in this embodiment. Substantially the same flipper 154 as disclosed in the first and second embodiments is rotatably mounted on a shaft between the lateral sides 152 of the collar in the same manner described above. The outer surface of the wedge member and the rear face of the flipper are complementary-shaped to mate with each other, and in the illustrated example are both substantially flat.

Figure 18:
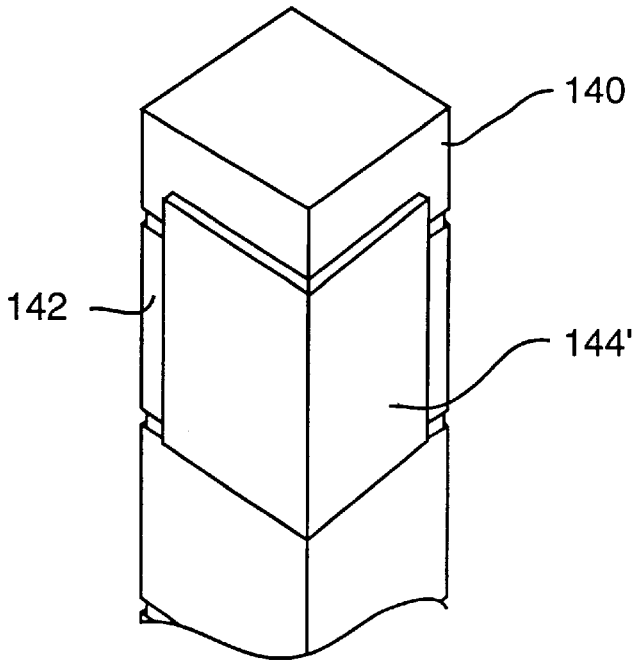
FIG. 18 is a partial perspective view of a support post and wedge member in accordance with a modification of the third embodiment of the present invention.
Figure 19:
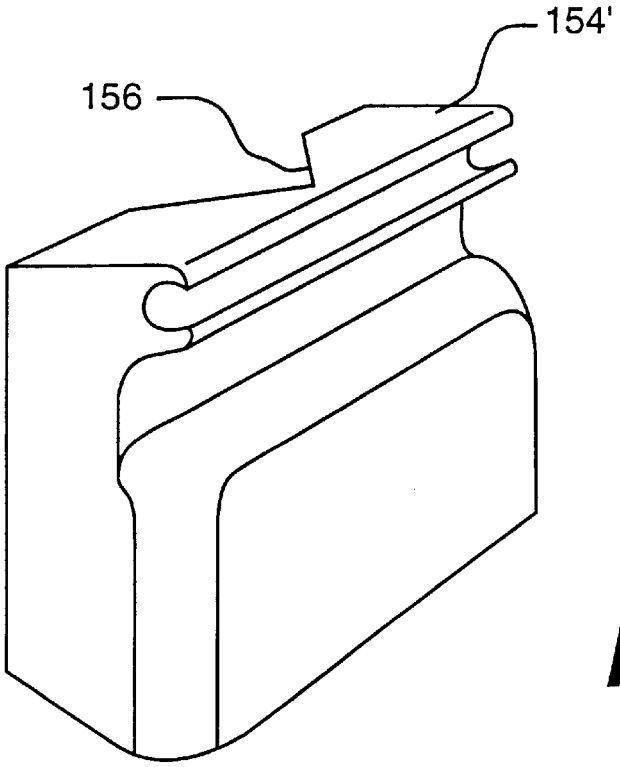
FIG. 19 is a perspective view of a flipper in accordance with the modified third embodiment of the present invention.

In a modification of the third embodiment, tapered wedge member 144' can be formed with a right-angled outer surface as shown in FIG. 18. To accommodate for this modification, flipper member 154' has a right-angled cut-out 156 in its rear face as shown in FIG. 19 to complement the shape of the wedge member, which is tapered as described above. The modified flipper is thus able to compress the wedge member in the same manner described above to create a wedging force for supporting a shelf.

Figure 20:
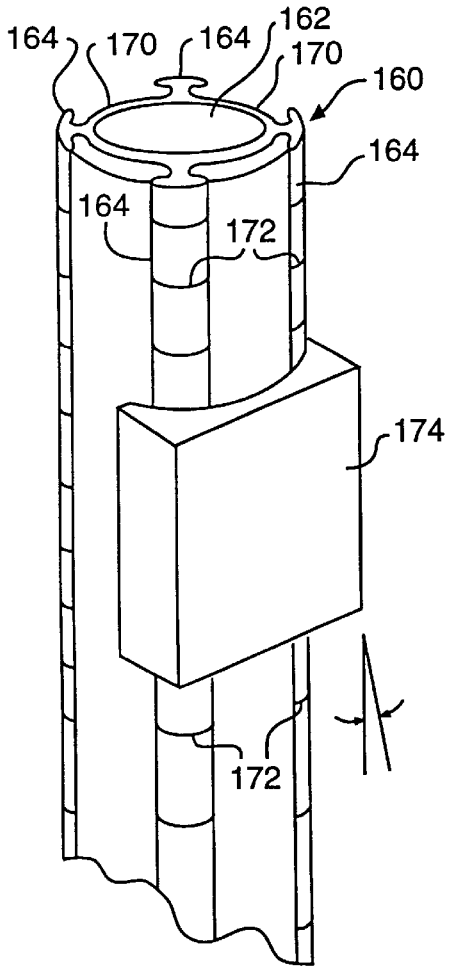
FIG. 20 is a partial perspective view of a flanged support post and wedge member in accordance with a fourth embodiment of the present invention.
Figure 21:
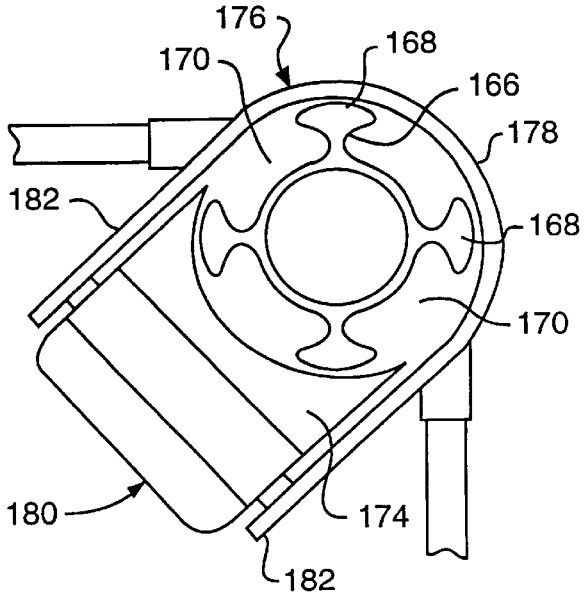
FIG. 21 is a top view of a corner portion of a shelving system in accordance with the fourth embodiment of the present invention.
Figure 22:
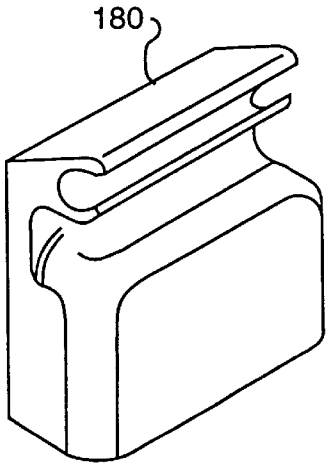
FIG. 22 is a perspective view of a flipper in accordance with the fourth embodiment of the present invention.

In the fourth embodiment, the support system of the present invention is used in conjunction with a flanged support post 160 as shown in FIG. 20. The flanged support post itself is the subject of U.S. application Ser. No. 08/426,674, and is formed to have an interior post 162 with a plurality of radially extending flanges 164 spaced equally about its circumference. With reference to FIGS. 20 and 21, each flange includes a first portion 166 extending radially from the interior post and a second portion 168 transverse to the first portion and having an arcuate outer periphery. Longitudinal slots 170 are formed between each adjacent pair of flanges 164. Lateral circumferential grooves 172 can also be formed on each flange and evenly spaced in the longitudinal direction.

A tapered wedge member 174 can be secured to the support post by the same or comparable detent means used to secure the wedge members in the above-described embodiments. Alternatively, the wedge member could be secured to the flanged support post by interacting with the longitudinal slots 170. The collar 176 shown in FIG. 21 has a rounded back section 178 contoured to fit around the circumference of the flanged support post. As in the other embodiments, a flipper 180 is rotatably secured between lateral sides 182 of the collar for compressing the wedge member.

Figure 31:
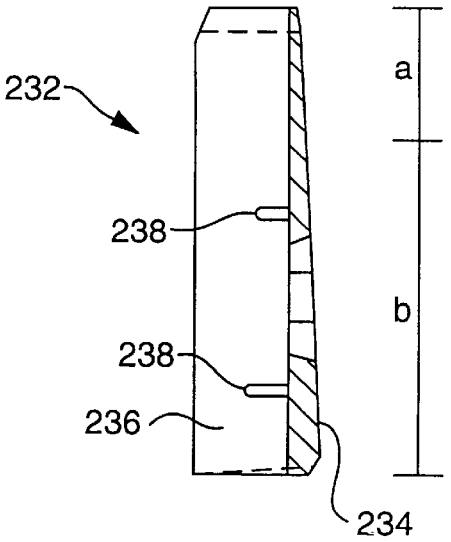
FIG. 31 is a side elevational view, partly in cross-section, of the wedge shown in FIG. 30.
Figure 32:
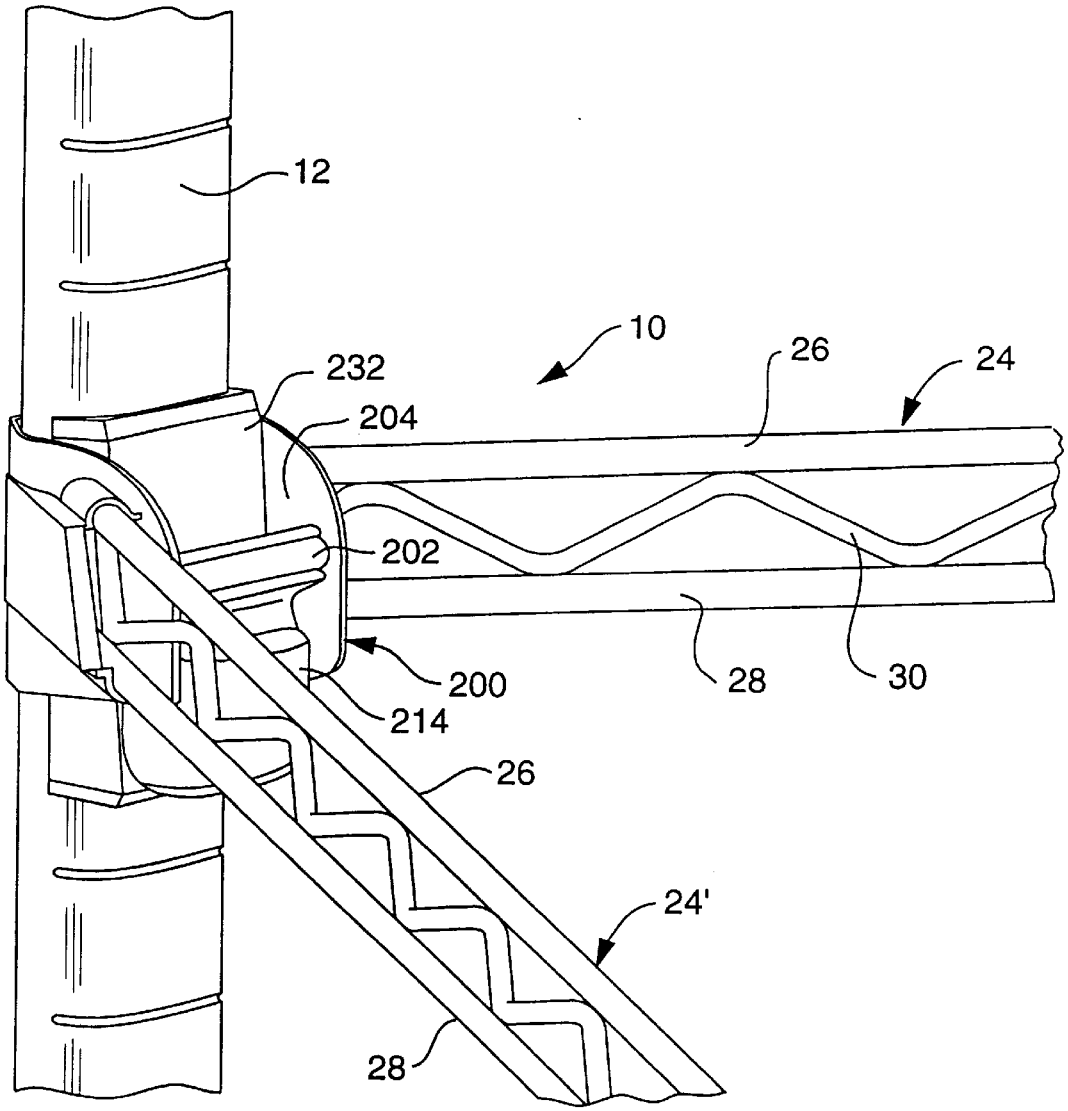
FIG. 32 is a perspective view of the support assembly in accordance with the fifth embodiment as viewed from above a wire shelf frame.
Figure 33:
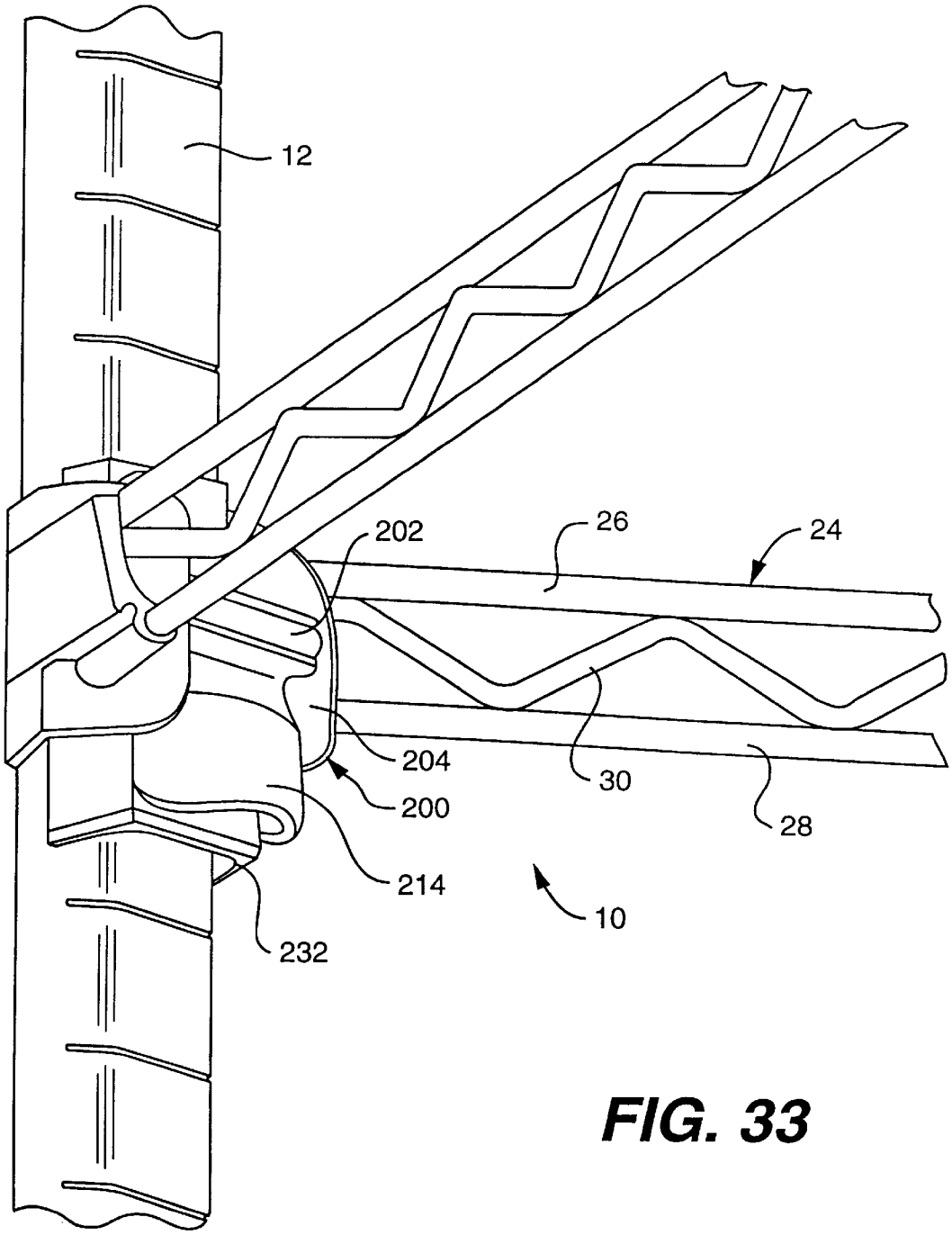
FIG. 33 is a perspective view of the support assembly in accordance with the fifth embodiment as viewed from below the wire shelf frame.

A fifth embodiment of present invention is shown in various isolated views in FIGS. 24 through 31 and in an assembled state in FIGS. 32 and 33. This embodiment generally features modified versions of several elements disclosed initially in connection with the first embodiment of the invention. More particularly, modifications of a collar and a flipper (collectively a corner support assembly) and of a tapered wedge member are disclosed below.

The modified elements are designed for use with a triangular support post 12 as shown in FIGS. 6A through 6C, as in the first disclosed embodiment. As will be appreciated, however, the following modifications are readily adapted to corner support assemblies and wedges designed for use with support posts of other shapes, including but not limited to the shapes disclosed in the second, third and fourth embodiments.

Figure 24:
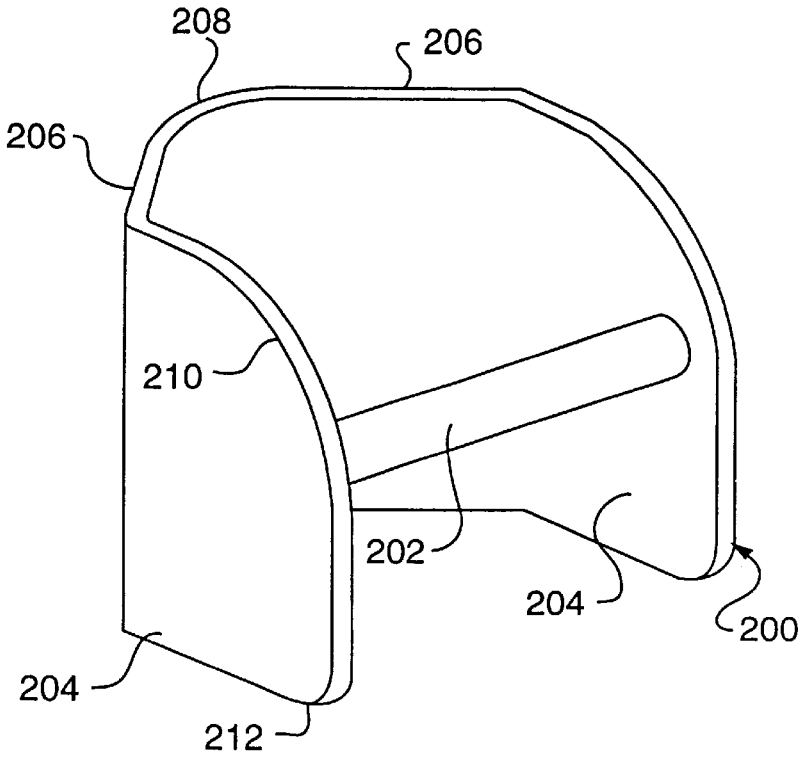
FIG. 24 is a perspective view of a collar in accordance with a fifth embodiment of the present invention.
Figure 25:
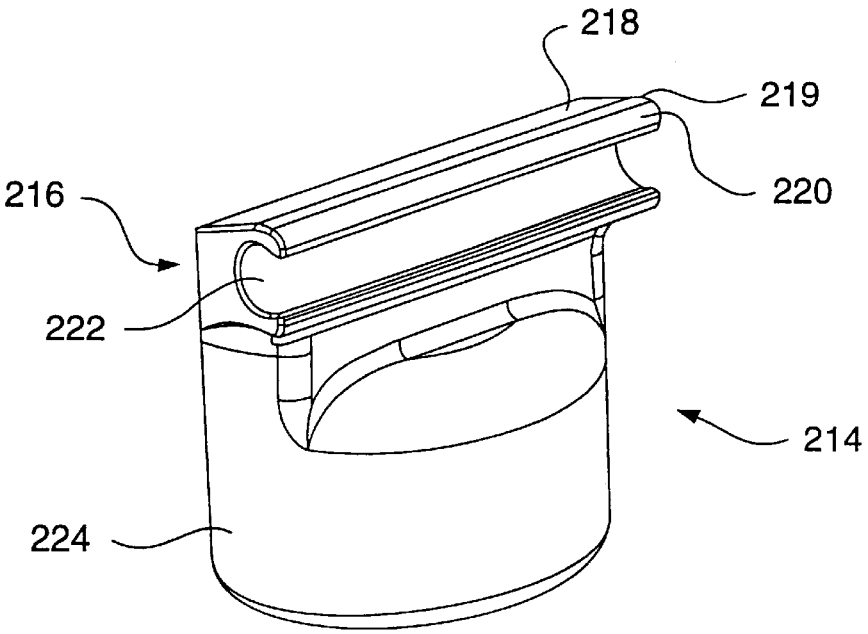
FIG. 25 is a perspective view of a flipper in accordance with the fifth embodiment of the present invention.

A collar 200 of the fifth embodiment is illustrated in FIGS. 24 and 25. As in the first embodiment, the collar includes a cylindrical shaft 202, preferably non-rotatable, secured between two lateral sides 204 for rotatably supporting a flipper. A rear section of the collar connecting the two lateral sides is contoured to fit the outward facing shape of the support post. With the post having a generally triangular cross-section in this embodiment as discussed above, the rear section is thus shaped to have straight portions 206 angled from each lateral side and joined by a rounded apex 208.

In this embodiment, the shaft 202 is secured at substantially the vertical center, or a middle portion, of the collar as shown in FIG. 24. In addition, a top portion 210 of the collar has a larger radius than the collar shown in FIG. 3. For example, in one embodiment the radius of the top portion 210 in FIG. 24 is 0.875" and the radius of a lower portion 212 of the collar is 0.250".

A flipper 214 in accordance with this embodiment is shown in FIGS. 25 through 29. The perspective view of FIG. 25 shows the flipper 214 to include, at its top end 216, a flat portion 218 and a rounded portion 220. In addition, a preferably flat transition portion 219 exists between the flat and rounded portions. An open cylindrical cavity 222 receives and contains the shaft 202 of the collar. As will be appreciated, the top end 216 of the flipper is substantially the same as the top end of the flipper disclosed in the first embodiment.

Figure 26:
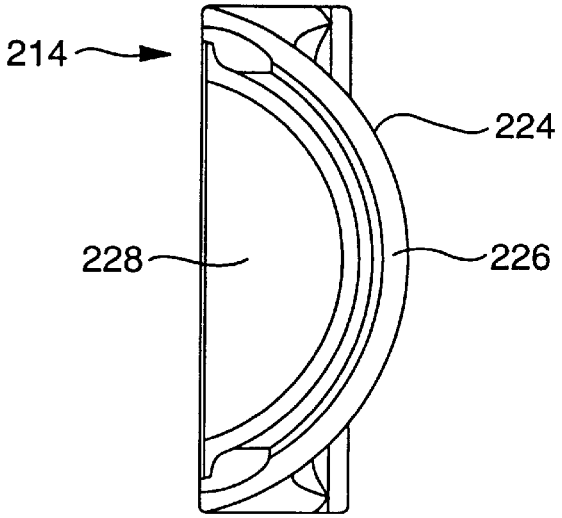
FIG. 26, is a bottom plan view of the flipper shown in FIG. 25.

The primary difference of the flipper in this embodiment is that its bottom end 224 is rounded instead of flat like the flipper shown in FIG. 4. As best seen in FIGS. 25 and 26, the rounded bottom end 224 also includes a rounded bottom edge 226. As in the first embodiment, the bottom edge is preferably chamfered. The rounding of this portion of the flipper provides a semi-circular cavity 228 in which the fingers of the user can comfortably rest when opening the flipper. Rounding the bottom end 224 also makes the flipper less susceptible to being accidentally opened by movement of articles on the shelf below.

Figure 27:
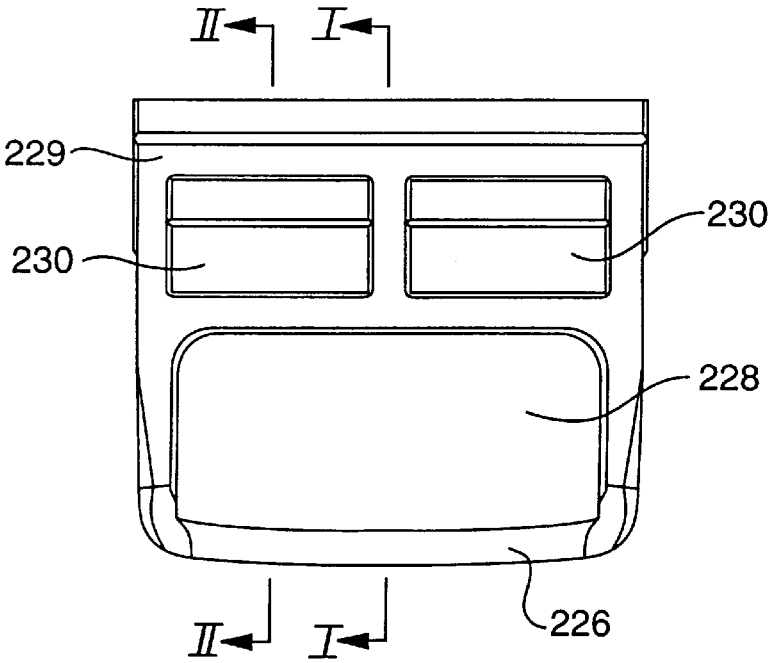
FIG. 27 is a rear elevational view of the flipper shown in FIG. 25.
Figure 28:
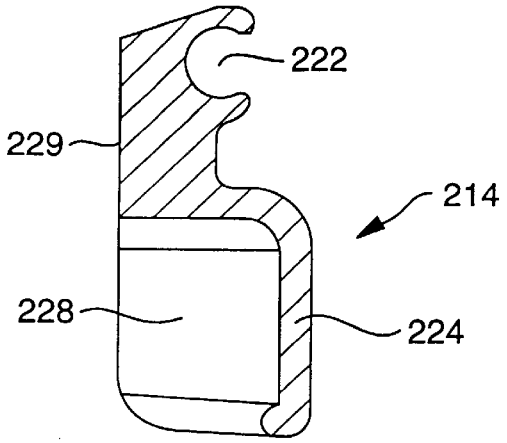
FIG. 28 is a cross-sectional view of the flipper taken long lines I—I in FIG. 27.
Figure 29:
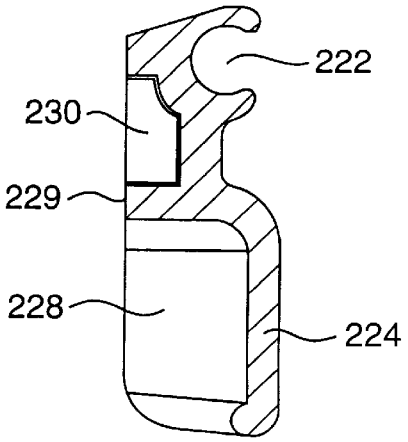
FIG. 29 is a cross-sectional view of the flipper, taken along lines II—II in FIG. 27.
Figure 30:
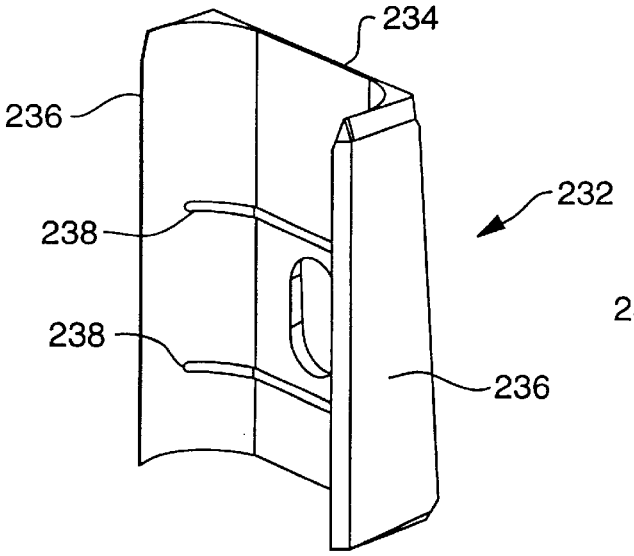
FIG. 30 is a perspective view of a wedge in accordance with the fifth embodiment of the invention.

As in the first embodiment, a rear face 229 of the flipper is substantially flat to complement the shape of the wedge member. As shown in FIGS. 27 and 29, however, the rear face 228 can include pockets 230 to aid in molding.

A wedge member 232 in this embodiment is substantially the same wedge member shown in FIG. 5, but with a greater body length. As in the first embodiment, the wedge member 232 in FIG. 30 includes a front portion 234 flanked by two contoured lips 236 for clipping, or snap-fitting, the wedge member onto the support post. Internal beads, or ribs, 238 are provided on the internal surface of the wedge member and are spaced at intervals corresponding to the spacing of grooves on the support post, as in the first embodiment.

The cross-sectional view of FIG. 31 illustrates the extra body length of the wedge member in this embodiment. The extra body length a, in this example 0.625", is added to the top portion of the wedge member 232, making its total length 2.625". As seen in this figure, the extra body length a is not tapered as is the remaining length b of the wedge member. As illustrated, the lower end is wider than the upper end so as to extend toward an interior end of the shelving system. In this embodiment, the taper is of the order of 4°.

As demonstrated in FIGS. 32 and 33, the collar, the flipper and the wedge member of this embodiment work together in the same manner disclosed in the first embodiment to securely support a shelf wire frame 10 on the support posts. In this embodiment, however, moving the shaft 202 to the center, or middle portion, of the collar serves to more evenly distribute the stress on the top and bottom rails, 26 and 28, of the wire shelf frame 10 where they are secured (such as by welding) to the collar 200. With this arrangement, the shelf sits a little higher up on the support assembly than in the first embodiment, and the longer wedge makes it easier to reduce or even eliminate the space between a corner of a shelf mat and the support post, which can trap dirt, food particles or other undesirable items.

A sixth embodiment of the present invention is shown in FIGS. 34 through 44. This embodiment generally features a modified collar and wedge member that provide a 'self-aligning' feature as the shelf frame is set in place. This feature allows for the wedge member to be 'cammed' into alignment with the corner support assembly by interaction with the collar. As will be appreciated, the modified elements in this embodiment will be most useful with a cylindrical support post of the type shown in FIG. 9 because of the relative tendency of the wedge member to become misaligned on such a support post.

Figure 34:
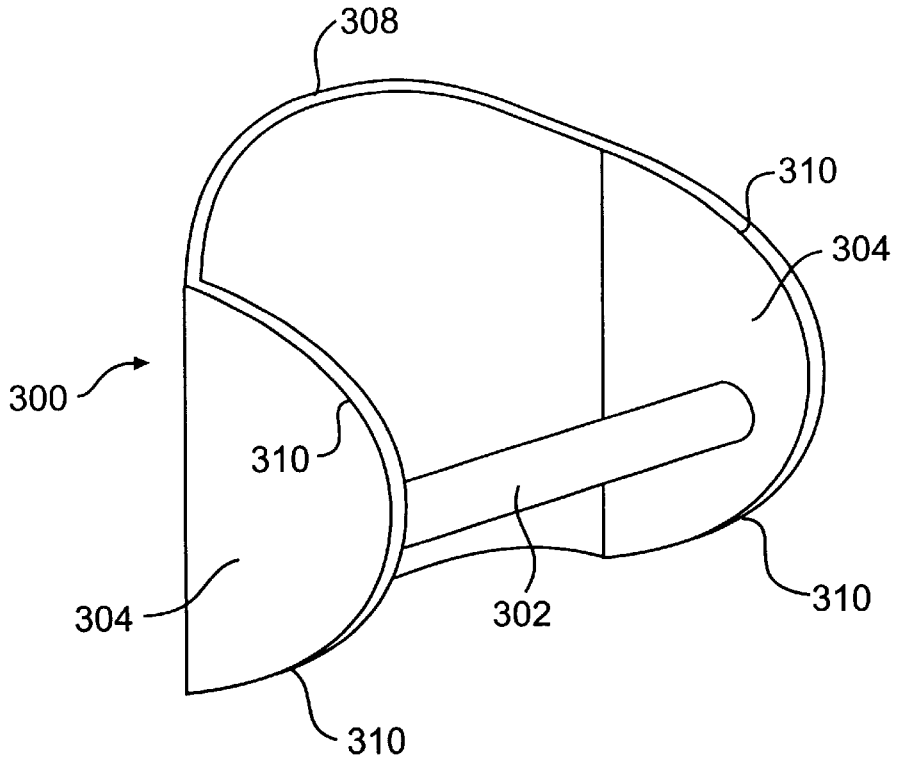
FIG. 34 is a perspective view of a collar in accordance with a sixth embodiment of the present invention.
Figure 35:
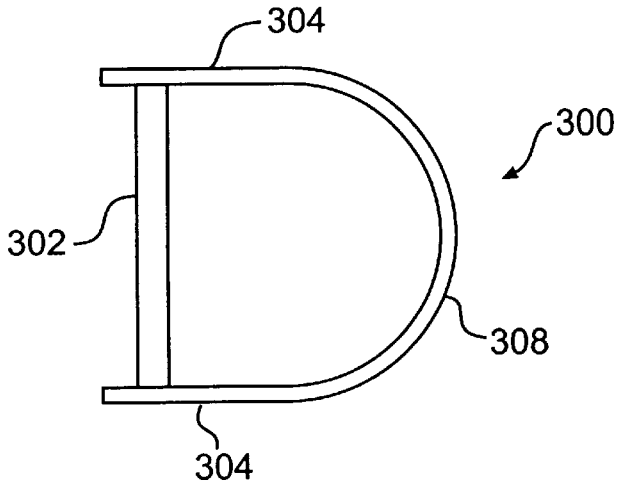
FIG. 35 is a top plan view of the collar in FIG. 34.

An isolated view of a collar 300 of the sixth embodiment is provided in FIGS. 34 and 35. As in the previous embodiments, the collar includes a cylindrical shaft 302, preferably non-rotatable, secured between two lateral sides 304 for rotatably supporting a flipper, or locking mechanism. A rear section 308 of the collar connecting the two lateral sides is contoured to fit a rounded sleeve which is discussed below. In this embodiment, the lateral sides are generally parallel to each other, and a cross-section of the collar is generally U-shaped as best seen in FIG. 35.

The primary modification of the collar in this embodiment is the shape of the corners, both top and bottom, of the lateral sides 304. As shown in FIG. 34, corners 310 of the lateral sides are shaped, e.g., rounded, to provide surfaces engagable with a wedge assembly as discussed in detail below. In a preferred example, the entire outer edge of the collar is arcuate to provide both the top and bottom corners with rounded portions.

The cylindrical shaft 302 is preferably located approximately at a middle portion of the collar 300 as discussed above in the fifth embodiment. However, the shaft can be placed at other locations on the collar without departing from the scope of the invention.

Figure 36:
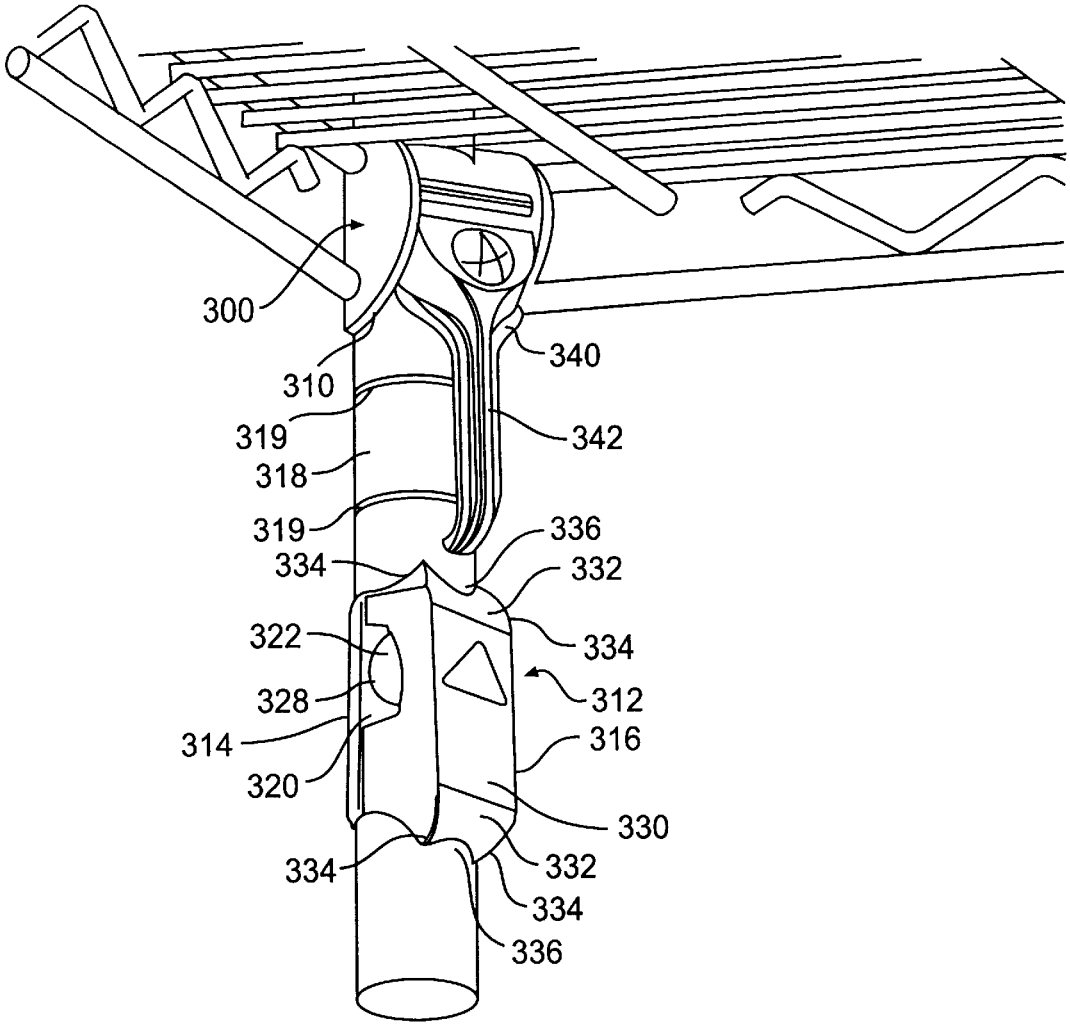
FIG. 36 is a partial perspective view of a shelving system in accordance with the sixth embodiment of the present invention.

The sixth embodiment also features a two-piece wedge assembly 312 instead of the wedge member discussed in the earlier embodiments. As seen in FIG. 36, the member assembly is formed of a sleeve 314 and a wedge 316 that are snap-fit or otherwise joined together about a support post 318. In this embodiment the wedge assembly employs a tongue 320 and groove 322 arrangement. The two-piece assembly allows the wedge to be easily detached and moved along the support post to the desired position. Although not seen in FIG. 36, both the sleeve and the wedge preferably have at least one internal bead, or ridge, for engaging horizontal grooves 319 in the support post. As shown in the figure, finger grip cutouts 328 can be provided in the tongue 320 for ease of removing the sleeve from the post.

Figure 37:
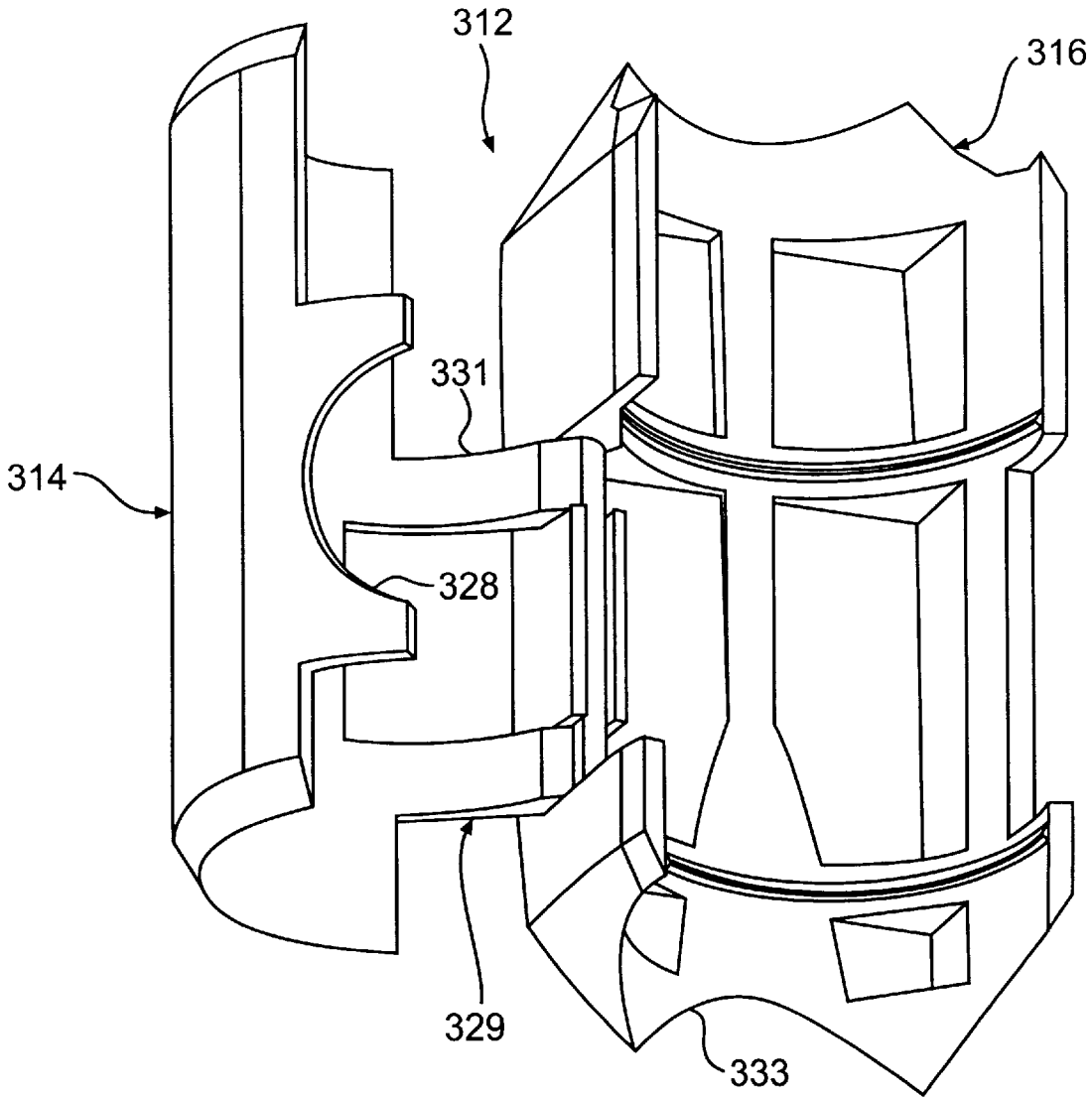
FIG. 37 is a perspective view of an alternative wedge assembly in accordance with the sixth embodiment of the present invention.
Figure 40:
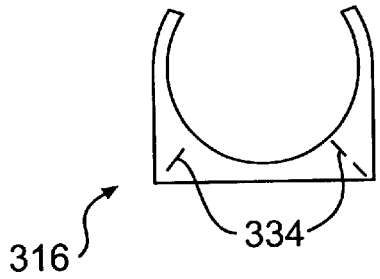
FIG. 40 is a top plan view of the wedge member in accordance with the sixth embodiment of the present invention.
Figure 39:
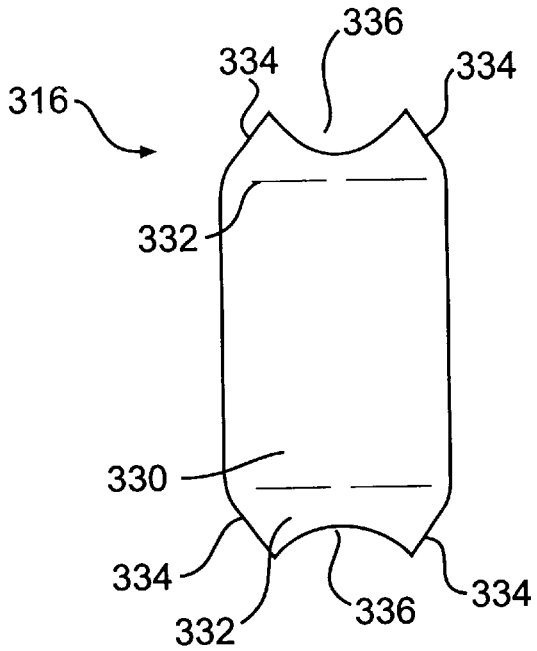
FIG. 39 is a front elevational view of the wedge member in accordance with the sixth embodiment of the present invention.
Figure 38:
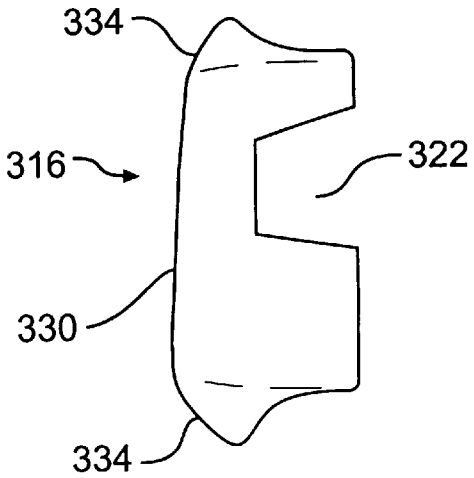
FIG. 38 is a side elevational view of a wedge member in accordance with the sixth embodiment of the present invention.

As an alternative to the tongue and groove arrangement shown in FIG. 36, the sleeve and the wedge can fit together by other comparable means. For example, FIG. 37 shows the sleeve 314 and wedge 316 connected by a hinge 329. In this arrangement the hinge is integral with the sleeve and has a pin 331 which rotatably fits in a slot 333 in the wedge. Of course, other types of hinges, e.g., a living hinge, can alternatively be used.

The shape of the wedge 316, in combination with the rounded corners of the collar, provides the self-aligning feature of this embodiment. As seen in FIGS. 36, as well as in FIGS. 37 through 40, the wedge has a planar face 330 that tapers from its upper end to lower end, as in the other embodiments, such that the lower end is wider and extends toward an interior of the shelving system. In this embodiment, opposite ends 332 of the face are arcuate, or rounded, and shaped to form inwardly directed ridges 334. The sides of the wedge 316 also taper toward the support post at opposite ends to help form the ridges. As seen in the figures, the two ridges 334 at each end of the wedge are curved toward each other and an arcuate cutout, or scallop, 336 is formed therebetween. Aligning numbers on the support post can be seen within the scallop, as shown in FIG. 36, when the wedge is preferably positioned.

As an alternative to the two-piece wedge assembly, a one-piece wedge assembly without the sleeve can also be used. In this alternative, a wedge would be formed with the same contour surfaces and ridges disclosed above, but the sides would extend further around the support post to secure the wedge without the need for a sleeve. Without the sleeve, the interior contour of the collar would of course be modified as necessary to fit around the support post and the wedge.

A flipper 340 shown in FIG. 36 has a handle 342 which is longer and narrower than in the other embodiments. The elongated shape of the handle provides more leverage and requires less pull force to open. In all other primary aspects, the flipper 340 has the same shapes and characteristics as disclosed in the other embodiments and is rotatably secured about cylindrical shaft 302 on the collar 300. Thus, it will be appreciated that the flippers disclosed in the other embodiments could also be used in this embodiment and vice-versa, i.e., the flipper 340 could be used in the other embodiments.

It will be appreciated that the flipper discussed in this embodiment, as well as the other embodiments, serves as a locking mechanism and is actuable (e.g., by rotating) between first and second positions as described above. As an alternative to such a flipper, however, a non-rotatable securing member can be provided. The securing member will function essentially in the same manner as the flipper, i.e., to press-fit against the wedge assembly, and can be structurally supported by the collar or formed as part of the collar.

Figure 41:
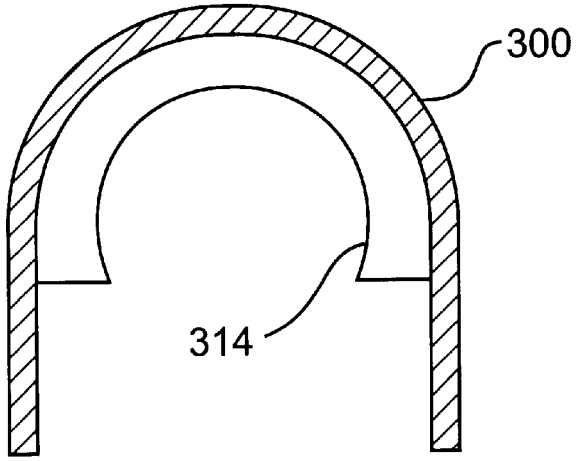
FIG. 41 is a top plan view, in section, of a collar and a sleeve in accordance with the sixth embodiment of the present invention.

FIG. 41 is a top view, in section, of the collar 300 and the sleeve 314 in the sixth embodiment. In this figure, the outside diameter of the sleeve is substantially the same as the inside diameter of the collar, thus making for an ideal fit between these components. However, if the outside or inside diameters, i.e., the mating surfaces, do not match, potential problems such as movement of the sleeve within the collar, e.g., rocking, or reduced overall stiffness of the shelving system can exist.

Figure 42:
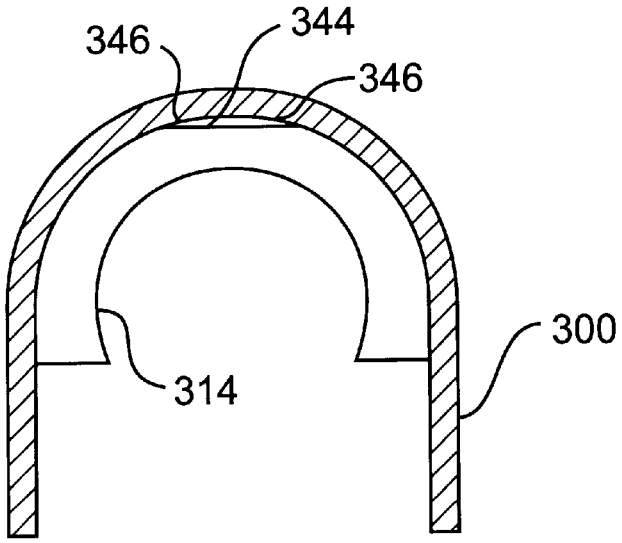
FIG. 42 is a top view, in section, of a collar and a modified sleeve in accordance with the sixth embodiment of the present invention.

To avoid such potential problems, FIG. 42 shows a sleeve that is modified to have a flat face 344, preferably at its circumferential midpoint and extending along its entire vertical length. The flat face provides two distinct contact points 346 for contacting the collar and preventing, or at least significantly reducing, movement between the sleeve and the collar that can occur when the mating surfaces do not match. The sleeve is otherwise the same as disclosed above.

The advantages provided by the elements disclosed in the sixth embodiment will be readily appreciated by the examples provided below.

Figure 43:
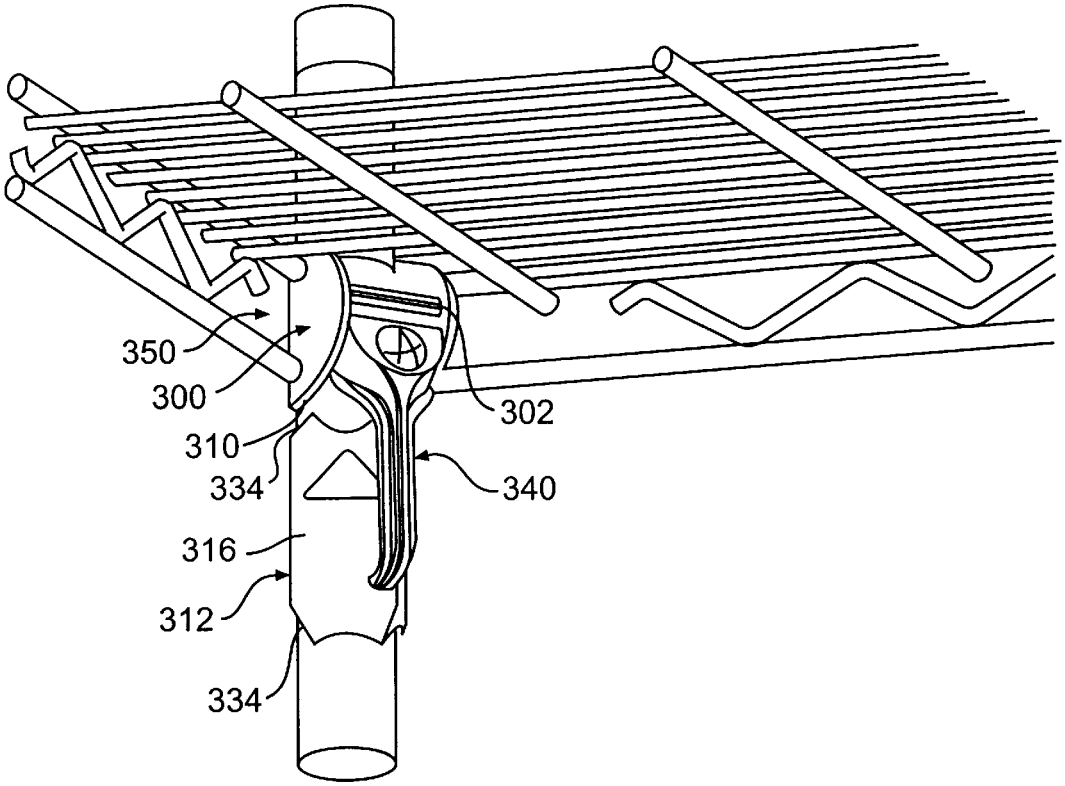
FIG. 43 is a perspective view of the corner assembly in accordance with the sixth embodiment of the present invention with the wedge assembly out of alignment.

In FIG. 43, the corner support assembly 350 is ready to be lowered onto the wedge assembly 312. However, in this view the wedge 316 is slightly out of alignment (too far to the left). As the corner assembly is lowered, the lower rounded corner 310 of the collar 300 will engage the ridge 334 on the wedge 316 and force, or cam, the wedge assembly to turn in a counterclockwise direction about its longitudinal axis and the support post until it is in alignment with the collar. As will be appreciated, the surfaces of the collar (i.e., rounded corner 310) and the camming surfaces of the wedge (i.e., ridge 334) are shaped so as to disengage from each other once the wedge is properly aligned. Such proper alignment is achieved when the face 310 of the wedge is in generally parallel alignment with the flipper 340 or, in other words, when the collar can slide over the wedge.

Figure 44:
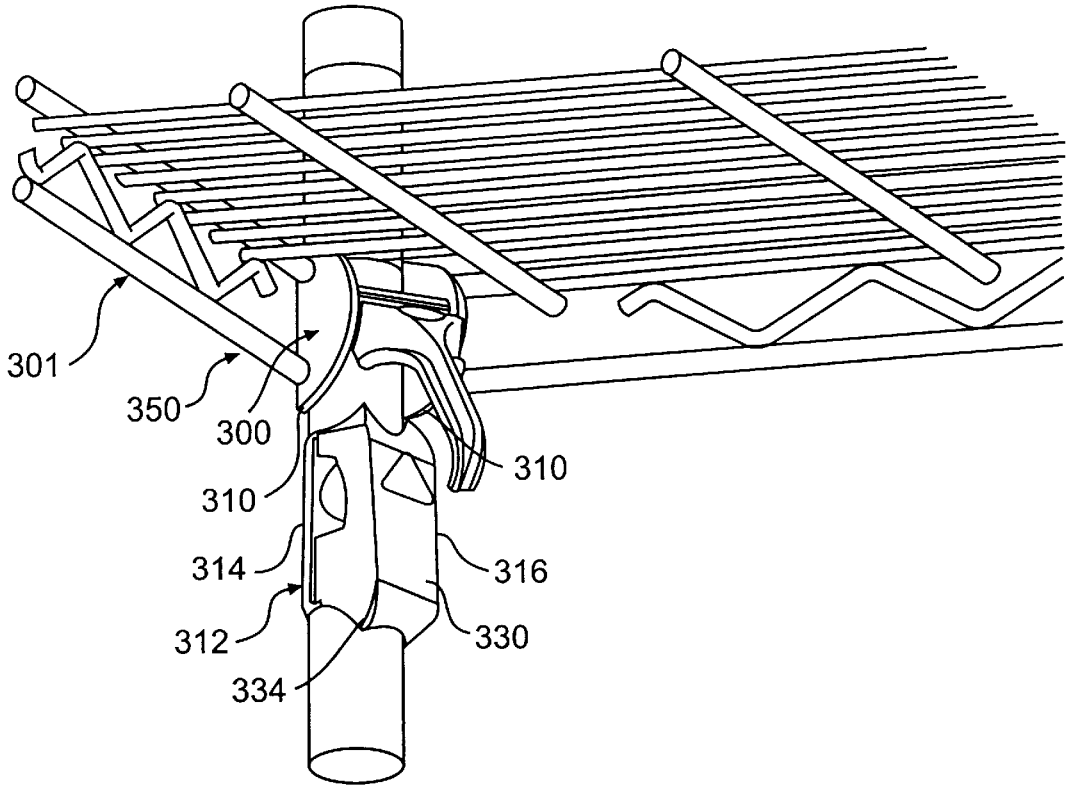
FIG. 44 is a perspective view of the corner assembly in accordance with the sixth embodiment of the present invention also with the wedge assembly out of alignment.

In FIG. 44, the wedge assembly is aligned too far to the right. As the corner assembly is lowered, the lower rounded corner 310 of the collar 300 will engage the ridge 334 on the wedge and turn the wedge assembly in a clockwise direction about the support post to its properly aligned position.

The ridges 334 on the lower end of the wedge allow for alignment of the wedge assembly when the corner assembly is being raised such as, for example, during 'bottom-up' assembly of the shelving system as described earlier. When the shelf frame 301 is being raised, top rounded corners of the collar will engage the lower ridges 334 to adjust the alignment of the wedge assembly if necessary.

As the foregoing description of the preferred embodiments describes, an advantage of the present invention is that it allows a user to quickly and easily change the height of the supported item, e.g., a shelf, to accommodate a variety of shelving applications. Moreover, since the support system allows the shelf frame to slide over the wedge member mounted on the support posts, height adjustment is easy and can be done without tools or without having to remove adjacent shelves. The shelf-aligning feature of the invention further eases assembly and/or adjustment of the shelving system.

Although specific embodiments of the present invention have been described above in detail, it will be understood that this description is merely for purposes of illustration. Various modifications of and equivalent structures corresponding to the disclosed aspects of the preferred embodiments in addition to those described above may be made by those skilled in the art without departing from the spirit of the present invention which is defined in the following claims, the scope of which is to be accorded the broadest interpretation so as to encompass such modifications and equivalent structures.

What is claimed is:

1. A system for supporting a member on a support post, comprising:

a wedge assembly having a tapered face and mountable on the support post, with said wedge assembly having a camming surface;

a collar adopted to be secured to the member to be supported, said collar having a first surface for abutting said camming surface and a second surface for press-fitting against said wedge assembly; and a locking mechanism rotatably mounted to said collar, said locking mechanism including said second surface for press-fitting against said wedge assembly.

2. A system according to claim 1, wherein said collar includes a pin for rotatably mounting said locking mechanism.

3. A system according to claim 1, wherein said second surface on said locking mechanism press-fits against said tapered face of said wedge assembly.

4. A system according to claim 1, wherein said locking mechanism translates relative to said wedge assembly, and with said locking mechanism in a first position passes over said wedge assembly when translating in one direction and creates a wedging force when translating in a second direction.

5. A support system, comprising:

a support post;

a wedge assembly, having a tapered portion, mounted on said support post;

support means for adjustably supporting a member to said support post; and aligning means for aligning said wedge assembly and said support means, said aligning means capable of rotating said wedge assembly about its longitudinal axis and relative to said support post for alignment.

6. A system according to claim 5, wherein said wedge assembly includes a wedge and a sleeve cooperating with each other about said support post.

7. A system according to claim 6, wherein said wedge and said sleeve have a tongue and groove assembly for cooperation with each other.

8. A system according to claim 6, wherein said wedge and said sleeve are hinged together.

9. A system according to claim 6, wherein said sleeve includes cutout portions.

10. A system according to claim 6, wherein an exterior of said sleeve has a flat surface.

11. A system according to claim 10, wherein said flat surface is disposed at a mid-portion of said sleeve and extends along its entire vertical length.

12. A system according to claim 5, wherein said aligning means includes a camming surface on said wedge assembly.

13. A system according to claim 12, wherein said camming surface is provided on top and bottom ends of said wedge assembly.

14. A system according to claim 12, wherein said camming surface comprises a ridge on said wedge assembly.

15. A system according to claim 5, wherein said aligning means includes a camming portion on said collar.

16. A system according to claim 15, wherein said camming portion on said collar comprises a rounded corner.

17. A system according to claim 16, wherein said rounded corners are provided on upper and lower portions of said collar.

18. A support system, comprising:

a support post;

a wedge assembly, having a tapered portion, mounted on said support post;

support means for adjustably supporting a member to said support post; and aligning means for aligning said wedge assembly and said support means, wherein said support means includes a locking mechanism having a first position for press-fitting against said wedge assembly and a second position for releasing the press-fitting.

19. A support system according to claim 18, wherein said support means further comprises a collar structurally associated with the supported member, with said locking mechanism rotatably supported by said collar.

20. A support system according to claim 18, wherein said locking mechanism has a handle for manipulating said locking mechanism between the first and second positions.

21. A system according to claim 18, wherein said locking mechanism includes a surface for press-fitting against a face of said wedge assembly.

22. A system according to claim 18, wherein said locking mechanism translates relative to said wedge assembly, and with said locking mechanism in a first position passes over said wedge assembly when translating in one direction and creates a wedging force when translating in a second direction.

23. A system for supporting a member, said system comprising:

a support post;

a wedge assembly with a tapered face and mounted to said support post, with said wedge assembly having a longitudinal axis and a camming surface; and a collar adopted to be secured to the member to be supported, said collar having a first surface and a second surface, wherein said first surface on said collar and said camming surface on said wedge assembly are engagable to turn said wedge assembly about its longitudinal axis and relative to said support post by a camming action from said collar, and said second surface on said collar press-fits against said wedge assembly.

24. A system according to claim 23, wherein said wedge assembly includes a wedge and a sleeve cooperating with each other about said support post.

25. A system according to claim 24, wherein said wedge and said sleeve include a tongue and groove assembly for cooperation with each other.

26. A system according to claim 24, wherein said wedge and said sleeve are hinged together.

27. A system according to claim 24, wherein said sleeve includes cutout portions.

28. A system according to claim 21, wherein an exterior of said sleeve has a flat surface.

29. A system according to claim 28, wherein said flat surface is disposed at a mid-portion of said sleeve and extends along its entire vertical length.

30. A system according to claim 23, wherein said camming surface on said wedge assembly comprises a ridge.

31. A system according to claim 23, wherein said first surface on said collar is a camming portion for abutting said camming surface.

32. A system according to claim 23, wherein said first surface on said collar comprises a rounded corner.

33. A system according to claim 32, wherein said rounded corner is formed on upper and lower portions of said collar.

34. A system for supporting a member, said system comprising:

a support post;

a wedge assembly with a tapered face and mounted to said support post, with said wedge assembly having a longitudinal axis and a camming surface;

a collar adopted to be secured to the member to be supported, said collar having a first surface and a second surface, wherein said first surface on said collar and said camming surface on said wedge assembly are engagable to turn said wedge assembly about its longitudinal axis by a camming action from said collar, and said second surface on said collar press-fits against said wedge assembly; and a locking mechanism supported by said collar, with said locking mechanism including said second surface for press-fitting against said wedge assembly.

35. A system according to claim 34, wherein said locking mechanism is actuable between a first position compressing said wedge assembly and supporting the member and a second position not compressing said wedge assembly.

36. A system according to claim 35, wherein said locking mechanism translates relative to said wedge assembly, and with said locking mechanism in the first position passes over said wedge assembly when translating in one direction and creates a wedging force when translating in a second direction.

37. A system for supporting a member, said system comprising:

a support post;

a wedge assembly with a tapered face and mounted to said support post, with said wedge assembly having a longitudinal axis and a camming surface; and a collar adopted to be secured to the member to be supported, said collar having a first surface and a second surface, wherein said first surface on said collar and said camming surface on said wedge assembly are engagable to turn said wedge assembly about its longitudinal axis by a camming action from said collar, and said second surface on said collar press-fits against said wedge assembly, wherein said camming surface is provided on top and bottom ends of said wedge assembly, and wherein said top and botom ends of said wedge assembly each include a pair of ridges, with each said pair of ridges curving toward each other and forming a scallop portion therebetween.

38. A system for supporting a member, said system comprising:

a support post;

a wedge assembly with a tapered face and mounted to said support post, with said wedge assembly having a longitudinal axis and a camming surface; and a collar adopted to be secured to the member to be supported, said collar having a first surface and a second surface, wherein said first surface on said collar and said camming surface on said wedge assembly are engagable to turn said wedge assembly about its longitudinal axis and relative to said support post by a camming action from said collar, and said second surface on said collar press-fits against said wedge assembly, wherein said second surface on said collar press-fits against said tapered face of said wedge assembly.

39. A system for supporting a member on a support post, comprising:

a wedge assembly, having a tapered portion, mountable on the support post;

support means, adapted to be secured to the member, for adjustably supporting the member to the support post; and aligning means for aligning said wedge assembly on the support post, said aligning means capable of rotating said wedge assembly about its longitudinal axis and relative to the support post for alignment.

40. A system for supporting a member on a support post, comprising:

a wedge assembly having a tapered face and mountable on the support post, with said wedge assembly having an angular camming surface; and a collar adopted to be secured to the member to be supported, said collar having a first surface for abutting said angular camming surface and a second surface for press-fitting against said wedge assembly, wherein said angular camming surface extends generally along a longitudinal axis of said wedge assembly, and wherein said first surface of said collar is capable of rotating said wedge assembly about the longitudinal axis and relative to the support post.

* * * * *

UNITED STATES PATENT AND TRADEMARK OFFICE

CERTIFICATE OF CORRECTION

PATENT NO. : 6,113,042
DATED : September 5, 2000
INVENTOR(S) : John H. Welsch et al.

It is certified that error appears in the above-identified patent and that said Letters Patent is hereby corrected as shown below:

Column 4,
Line 42, "stop" should read -- top --.

Column 17,
Line 24, "adopted" should read -- adapted --.

Column 18,
Line 49, "adopted" should read -- adapted --.

Column 19,
Line 1, "claim 21," should read -- claim 24, --.
Line 21, "adopted" should read -- adapted --.
Line 50, "adopted" should read -- adapted --.

Column 20,
Line 17, "adopted" should read -- adapted --.
Line 45, "adopted" should read -- adapted --.

Signed and Sealed this

Twenty-ninth Day of January, 2002

*Attest:*

*Attesting Officer*

JAMES E. ROGAN
*Director of the United States Patent and Trademark Office*